US008052143B2

(12) United States Patent
Yamamoto et al.

(10) Patent No.: US 8,052,143 B2
(45) Date of Patent: Nov. 8, 2011

(54) PAPER INVERTING DEVICE

(75) Inventors: Kazuya Yamamoto, Kinokawa (JP); Akira Kawaguchi, Kinokawa (JP)

(73) Assignees: Duplo Seiko Corporation, Wakayama (JP); Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/448,792

(22) PCT Filed: Aug. 28, 2008

(86) PCT No.: PCT/JP2008/002332

§ 371 (c)(1), (2), (4) Date: Jul. 7, 2009

(87) PCT Pub. No.: WO2009/031281

PCT Pub. Date: Mar. 12, 2009

(65) Prior Publication Data

US 2010/0156037 A1 Jun. 24, 2010

(30) Foreign Application Priority Data

Sep. 7, 2007 (JP) ..... 2007-232475

(51) Int. Cl.
*B65H 5/00* (2006.01)
*B65H 29/00* (2006.01)

(52) U.S. Cl. ..... 271/225; 271/184; 271/185; 271/186; 271/303

(58) Field of Classification Search ..... 271/225, 271/184–186, 303
See application file for complete search history.

(56) References Cited

U.S. PATENT DOCUMENTS

| | | | | |
|---|---|---|---|---|
| 4,078,489 | A | 3/1978 | Davis | |
| 5,120,037 | A * | 6/1992 | Takimoto | 271/3.18 |
| 5,275,394 | A | 1/1994 | Mank et al. | |
| 5,439,208 | A * | 8/1995 | Moser et al. | 271/225 |
| 5,618,036 | A * | 4/1997 | Edwards et al. | 271/225 |
| 5,664,772 | A * | 9/1997 | Auerbach et al. | 271/225 |
| 6,227,532 | B1 * | 5/2001 | Bakoledis | 271/9.13 |
| 7,881,652 | B2 * | 2/2011 | Edwards et al. | 399/364 |

FOREIGN PATENT DOCUMENTS

| | | |
|---|---|---|
| JP | 05-078000 | 3/1993 |
| JP | 05-107968 | 4/1993 |
| JP | 06-025460 | 7/1994 |
| JP | 08-091624 | 4/1996 |
| JP | 2002-103768 | 4/2002 |
| JP | 2004-001290 | 1/2004 |
| JP | 2006044911 A * | 2/2006 |

* cited by examiner

*Primary Examiner* — Stefanos Karmis
*Assistant Examiner* — Luis A Gonzalez
(74) *Attorney, Agent, or Firm* — Fildes & Outland, P.C.

(57) ABSTRACT

When a sheet of paper is inverted and the direction is changed, members such as a roller do not come into contact with the printed surface of the sheet and it is possible to prevent smudges by eliminating an ink stain on a surface of the sheet.

9 Claims, 27 Drawing Sheets

PAPER INVERTING DEVICE

TECHNICAL FIELD

The present invention relates to a paper inverting device and a technique for inverting a sheet of paper at a point of a transport path of the sheet in a printer and the like.

BACKGROUND ART

In the prior art, this kind of device is described in, for example, Japanese Patent Laid-Open No. 54-57759. In this invention, the transport path of a sheet of paper is inverted around an axis tilted by 45° relative to a traveling direction, so that the sheet moving on the transport path is inverted by 180° and the direction is changed by 90° relative to the traveling direction.

In Japanese Patent Laid-Open No. 63-134437, a sheet of paper is inverted at a point of a loop transport path around an axis along a transport direction.

In Japanese Patent Laid-Open No. 2000-135851, an intermediate transport path is provided like conveyer belts which are a plurality of belts looped over a pair of rollers. On the intermediate transport paths, an inverting/refeeding roller is disposed so as to have an axial direction tilted by 45° relative to a transport direction. A plurality of auxiliary rollers are pressed in contact with the inverting/refeeding roller and inverting guides provided between the auxiliary rollers are disposed close to the outer surface of the inverting/refeeding roller with a small gap. A sheet of paper is transported on the intermediate transport path while being sucked by a suction fan. The sheet introduced between the inverting/refeeding roller and the auxiliary rollers is guided by the inverting guides so as to be turned along the outer surface of the inverting/refeeding roller, so that the traveling direction of the sheet is changed by 90°.

DISCLOSURE OF THE INVENTION

Problems to be Solved by the Invention

In the configurations of the prior art, a sheet of paper is transported while being sandwiched (nipped) between the rollers and the rollers directly come into contact with the printed surface of the sheet. Thus when a paper inverting device configured according to the prior art is applied to a stencil duplicator and an inkjet printer, a printed surface may be smudged.

The present invention has been devised to solve the problem. An object of the present invention is to provide a paper inverting device which does not bring members such as a roller into contact with the printed surface of a sheet of paper when the sheet is inverted and the direction is changed, and can prevent smudges by eliminating an ink stain on the surface of the sheet.

Means for Solving the Problems

In order to solve the problem, a paper inverting device of the present invention for inverting a sheet of paper around an inversion axis by a predetermined inversion angle when the sheet is transferred from a first transport surface to a second transport surface, wherein a first transport device forming the first transport surface and a second transport device forming the second transport surface each include a plurality of transport belts moving on transport paths along a paper transport direction and a suction device for sucking the sheet on the transport belts through suction holes formed on the transport belts, a turn guide disposed in parallel with the inversion axis between the first transport device and the second transport device has a plurality of guide ribs disposed along the inversion axis, the guide ribs are disposed between the transport belts, and the guide ribs which are in slidable contact with the sheet have slidable contact portions forming curved inversion/transfer surfaces from inversion start points corresponding to the first transport surface to inversion end points corresponding to the second transport surface.

With this configuration, the first transport device sucks on the transport belts the opposite side of the sheet from a printed surface through the suction holes formed on the transport belts, by means of the suction device. The transport belts move on the transport paths with the sheet in this state, so that the sheet is transported in the paper transport direction on the first transport surface.

When the sheet reaches the turn guide and one end of the sheet enters the inversion/transfer surfaces from the inversion start point of the turn guide, the guide ribs guide the end of the sheet with the inversion/transfer surfaces as the sheet moves in the paper transport direction, the back side of the sheet comes into slidable contact with the inversion/transfer surfaces, and the surfaces of the sheet are inverted and curved along the inversion/transfer surfaces, following the end of the sheet.

When the sheet reaches the second transport device and the end of the sheet enters the second transport surface from the inversion end points of the inversion/transfer surfaces of the turn guide, the second transport device sucks on the transport belts the opposite side of the sheet from the printed surface through the suction holes formed on the transport belts, by means of the suction device. The transport belts move on the transport paths with the sheet in this state, so that the sheet is transported in the paper transport direction on the second transport surface. At this point, the first transport device transports the sheet until the rear end of the sheet reaches the inversion start point of the turn guide.

Consequently, while the sheet is transferred from the first transport surface of the first transport device to the second transport surface of the second transport device through the inversion/transfer surfaces of the turn guide, the sheet is inverted at the turn guide around the inversion axis by a predetermined inversion angle in a state in which the back side of the sheet is in slidable contact with the inversion/transfer surfaces of the turn guide, without bringing the printed surface of the sheet into contact with the component members of the inverting device.

Thus members such as a roller do not come into contact with the printed surface of the sheet during the inversion of the sheet and it is possible to prevent smudges by eliminating an ink stain on the surface of the sheet.

Further, the inversion/transfer surfaces of the turn guide are not disposed over the direction of the inversion axis and are intermittently and partially formed at predetermined intervals along the inversion axis by the plurality of guide ribs disposed between the transport belts, so that a contact resistance between the sheet and the inversion/transfer surfaces can be reduced at the turn guide to smoothly invert and transport the sheet.

Moreover, the first transport device and the second transport device are disposed at relative positions where the inversion axis is tilted by a predetermined angle relative to a direction orthogonal to the paper transport direction of the first transport device and a predetermined turning angle is formed between the transport direction of the first transport device and the transport direction of the second transport device, and the turn guide is disposed in parallel with the inversion axis.

With this configuration, the turn guide is disposed along a direction tilted by a predetermined angle relative to a direction orthogonal to the paper transport direction of the first transport device, so that a corner on one side of the sheet first reaches the turn guide and then one end of the sheet enters the inversion/transfer surfaces from the corner. The entry of the end of the sheet to the inversion/transfer surfaces is delayed as being close to a corner on the other side of the sheet.

As the sheet moves in the paper transport direction, the guide ribs guide the end of the sheet with the inversion/transfer surfaces, the back side of the sheet comes into slidable contact with the inversion/transfer surfaces, and the surfaces of the sheet are inverted and curved along the inversion/transfer surfaces, following the end of the sheet. At this point, the sheet is first inverted from the corner on one side having first entered the inversion/transfer surfaces and the start of the inversion is delayed as being close to the corner on the other side of the sheet, so that the transport direction of the sheet is changed.

In other words, when the sheet is transferred from the first transport surface to the second transport surface, the turn guide inverts the sheet by the predetermined inversion angle around the inversion axis tilted by the predetermined angle relative to a direction orthogonal to the paper transport direction of the first transport device, so that the transport direction of the sheet is changed by the predetermined turning angle.

When the sheet reaches the second transport device and the end of the sheet enters the second transport surface from one corner of the end, the second transport device transports the sheet in the paper transport direction on the second transport surface. At this point, on the second transport surface, the sheet returns to a position where the end is in parallel with a direction orthogonal to the paper transport direction.

Further, the turn guide disposed in parallel with the inversion axis has escape portions at the inversion start points corresponding to the first transport surface and between the guide ribs corresponding to the corner of the sheet. The escape portions are extended from the guide rib disposed inside the corner of the sheet to the guide rib disposed outside the corner of the sheet, and have escape portion front ends which come into slidable contact with the end of the sheet so as to gradually retreat in the paper transport direction as being close to the guide rib disposed outside the corner of the sheet.

With this configuration, when the sheet is transferred from the first transport surface to the second transport surface, the sheet is inverted by the predetermined inversion angle and the direction of the sheet is changed by the predetermined turning angle by passage through the turn guide. At this point, as the sheet moves in the paper transport direction, the guide ribs guide the end of the sheet with the inversion/transfer surfaces, the sheet is first inverted from the corner on one side having first entered the inversion/transfer surfaces, and the surfaces of the sheet are inverted and curved along the inversion/transfer surfaces, following the end of the sheet.

When the corner on one side of the sheet enters between the guide ribs while being bent lower than the inversion/transfer surfaces by a curl and the like of the sheet, the corner is not inverted, thereby interfering with the inversion of a side edge on one side of the sheet, following the corner. Thus a paper jam occurs.

However, in the foregoing configuration, the escape portion front ends of the escape portions provided between the guide ribs corresponding to the corner of the sheet come into slidable contact with the edge of the corner of the sheet which has been bent lower than the inversion/transfer surfaces. The escape portion front ends are formed so as to gradually retreat in the transport direction, so that as the sheet moves in the paper transport direction, the escape portions guide the end of the sheet upward with the escape portion front ends, the position of the corner on one side of the sheet is corrected, and the corner is smoothly inverted. Thus it is possible to prevent a paper jam.

Moreover, the escape portion front ends are tilted by a predetermined angle relative to the first transport surface of the first transport device and are tilted by a predetermined angle relative to a direction orthogonal to the transport direction. The rear ends of the escape portions having retreated in the paper transport direction are disposed on guide surfaces formed between the guide ribs.

Further, the escape portions are preferably made up of flexible members separated from the turn guide.

The guide ribs are arranged with a predetermined pitch along the inversion axis and are formed with a center distance of 20 mm to 50 mm in a direction orthogonal to the paper transport direction.

Moreover, the transport device includes low-friction members on portions where the transport belts slide.

Further, the transport belt has a plurality of protrusions formed on the surface coming into contact with the sheet of paper.

In the foregoing configuration, when paper powder from the transported sheet falls between the transport belts and the sheet sucked on the transport belts, the sheet may slide. However, by collecting paper powder between the plurality of protrusions provided on the transport belts, it is possible to prevent the paper powder from falling between the transport belts and the sheet, so that the sheet can be reliably transported. Further, by engaging the rear end of the sheet onto the protrusions of the transport belts, the sheet can be pressed and reliably transported.

Moreover, the transport device includes belt rollers for driving the transport belts. The belt rollers have a plurality of protrusions formed on portions pressed to the transport belts.

In the foregoing configuration, when paper powder falls between the transport belts and the belt rollers, the transport belts may slide. However, by collecting paper powder between the plurality of protrusions provided on the belt rollers, it is possible to prevent the paper powder from falling between the belt rollers and the transport belts, so that the transport belts can be reliably driven.

Further, the transport device includes paper support members between the plurality of transport belts.

With this configuration, when the sheet is transported by suction on the transport belts in the first transport device and the second transport device, the sheet is supported by the paper support members between the transport belts to prevent a deformation of the sheet, thereby preventing wrinkles when the sheet is inverted.

ADVANTAGES OF THE INVENTION

As has been discussed, according to the present invention, the printed surface of a sheet of paper is inverted at a turn guide around an inversion axis without coming into contact with the component members of an inverting device while the sheet is transferred from the first transport surface of a first transport device to the second transport surface of a second transport device through the inversion/transfer surfaces of the turn guide. Thus it is possible to prevent smudges by eliminating an ink stain on the surface of the sheet.

Since a plurality of guide ribs form the inversion/transfer surfaces, a contact resistance can be reduced to smoothly invert and transfer the sheet of paper. The turn guide inverts the sheet by a predetermined inversion angle around the inversion axis tilted by a predetermined angle relative to a direction orthogonal to the paper transport direction of the first transport device, so that the direction of the sheet can be changed by a predetermined turning angle. The escape portion front ends of the escape portions provided between the guide ribs come into slidable contact with the end of the corner of the sheet which has been bent lower than the inversion/transfer surfaces, guide the end of the sheet upward to the inversion/transfer surfaces, and correct the position of the corner on one side of the sheet to smoothly invert the corner. Thus it is possible to prevent a paper jam. By collecting paper powder between the plurality of protrusions provided on transport belts and between the plurality of protrusions provided on belt rollers, the sheet can be reliably transported. The paper support members prevent a deformation of the sheet between the transport belts, thereby preventing wrinkles.

BEST MODE FOR CARRYING OUT THE INVENTION

The following will describe embodiments of the present invention in accordance with the accompanying drawings. First, referring to FIGS. 20 to 24, the application of a paper inverting device and the transport path of a sheet of paper will be discussed according to the present invention.

Figure 20:
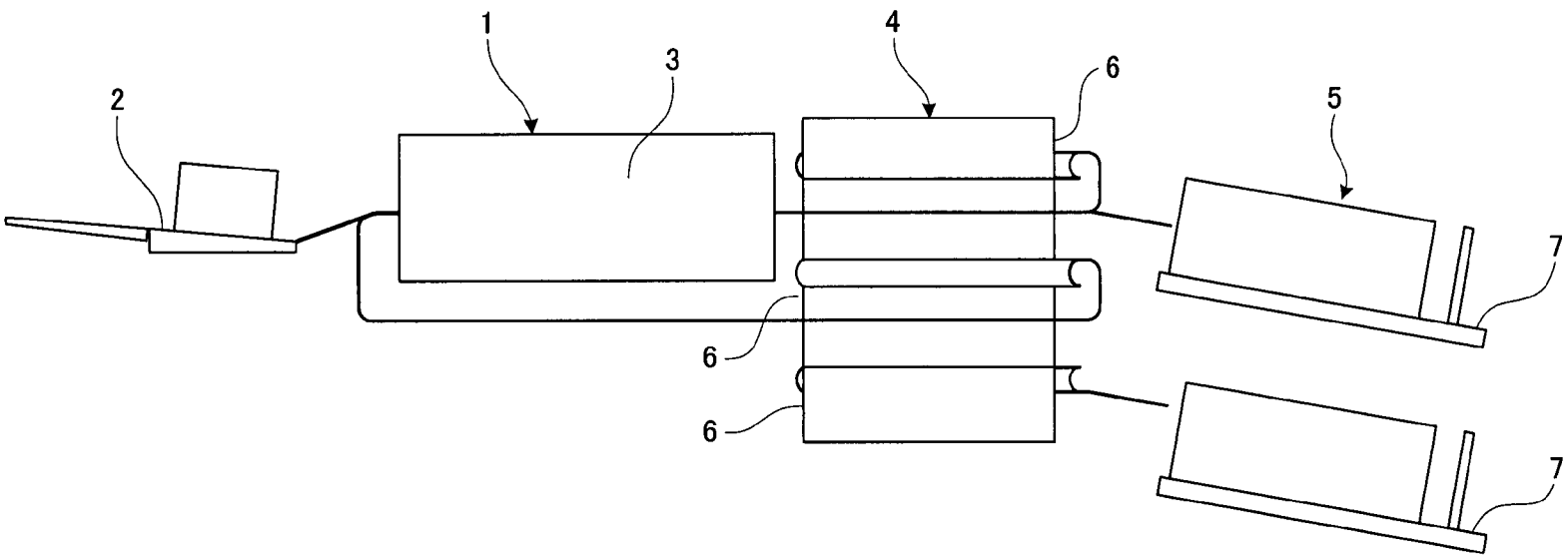
FIG. 20 is a schematic diagram showing a transport path of a sheet according to the embodiment of the present invention.
Figure 21:
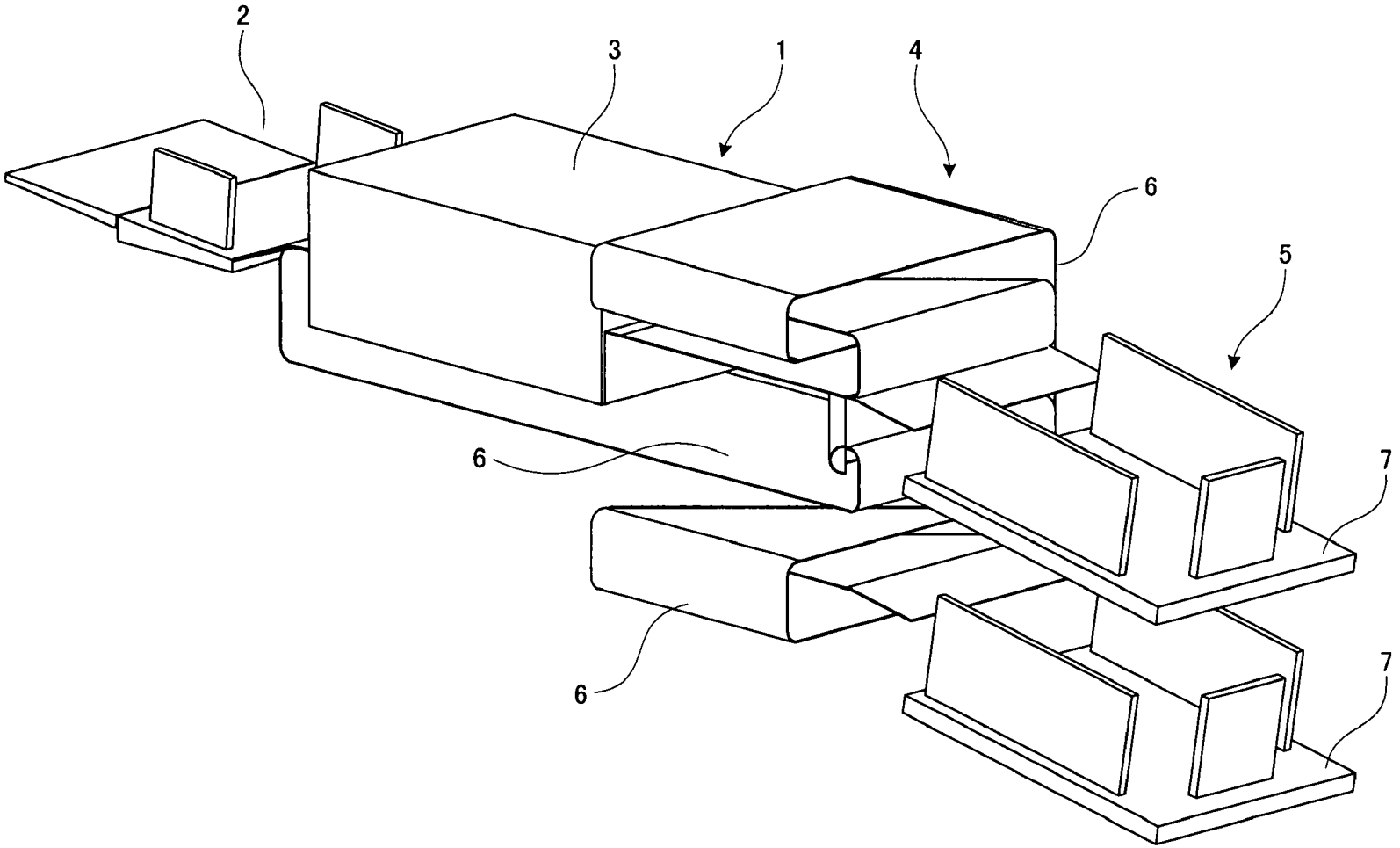
FIG. 21 is a schematic diagram showing the transport path of the sheet according to the embodiment of the present invention.

FIGS. 20 and 21 illustrate an ink jet printer as an application of the paper inverting device of the present invention. The present invention is also applicable to a stencil duplicator, a screen printer, and so on.

(Overall Configuration)

An ink jet printer 1 is made up of a paper feed mechanism 2, a printer body 3, a paper inverting mechanism 4, and a paper receiving mechanism 5. In this configuration, the printer body 3 performs printing by jetting water-based ink to a surface of a sheet of paper according to an inkjet printing system. The paper inverting mechanism 4 is a combination of a plurality of inverting transfer units 6 which are respectively disposed on the top stage, the middle stage, and the bottom stage, so that a plurality of transport paths can be selectively formed. The paper receiving mechanism 5 is made up of a plurality of paper receiving units 7. Sheets of paper ejected from the paper inverting mechanism 4 are received by the paper receiving units 7 which selectively correspond to the plurality of transport paths formed in the paper inverting mechanism 4.

(Single-Sided Printing)

Figure 22:
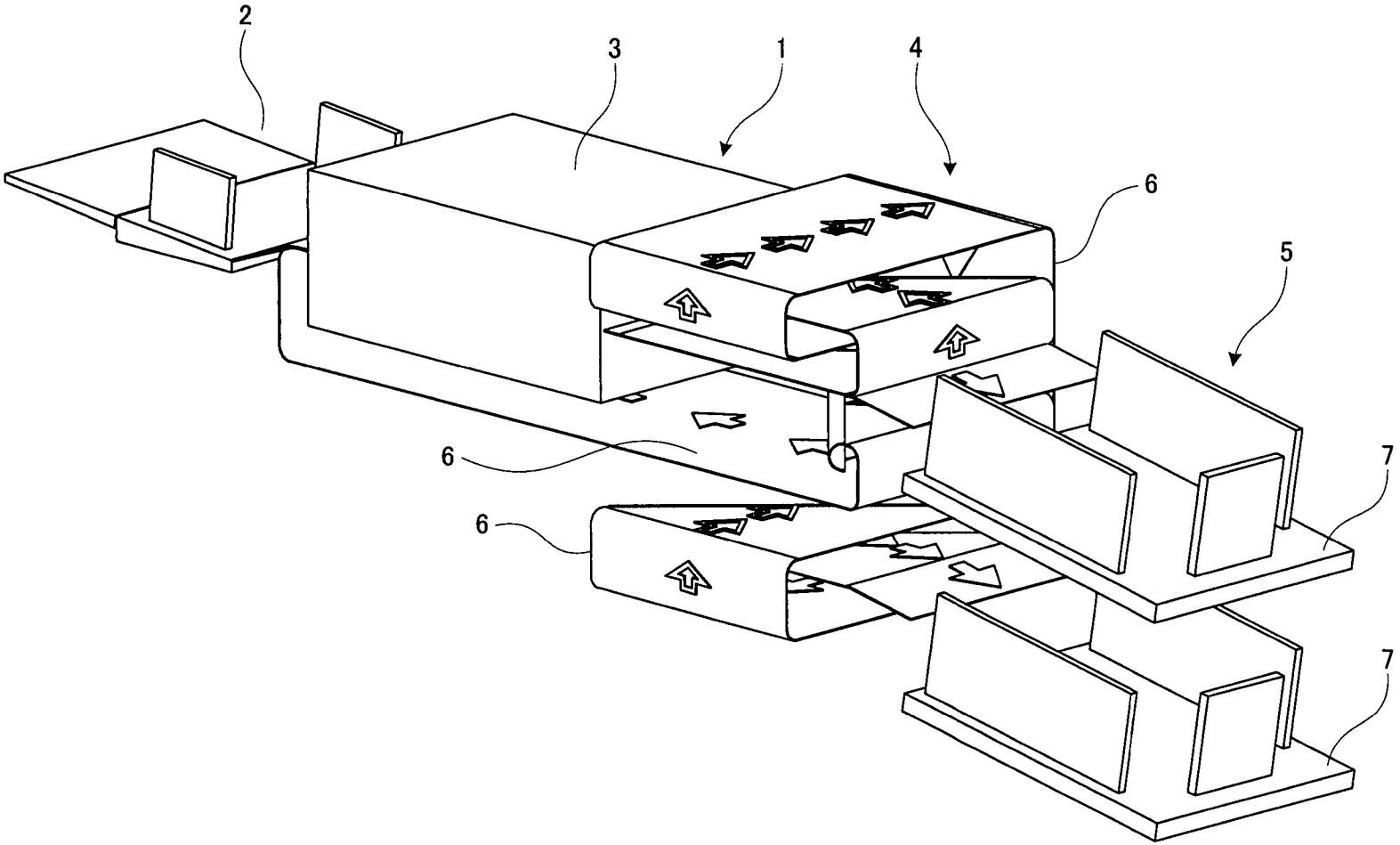
FIG. 22 is a schematic diagram showing the transport path of the sheet according to the embodiment of the present invention.
Figure 23:
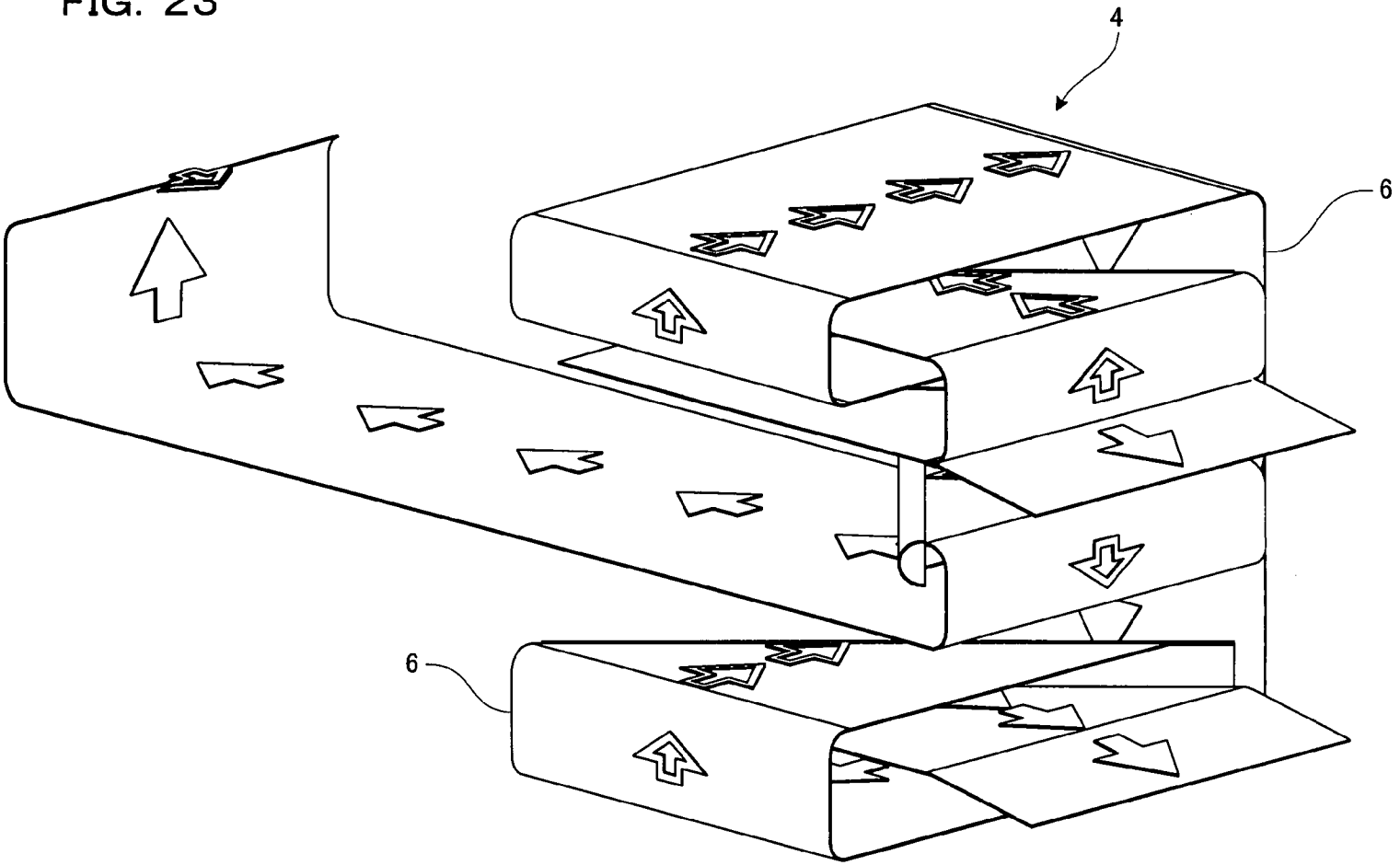
FIG. 23 is a schematic diagram showing the transport path of the sheet according to the embodiment of the present invention.
Figure 24:
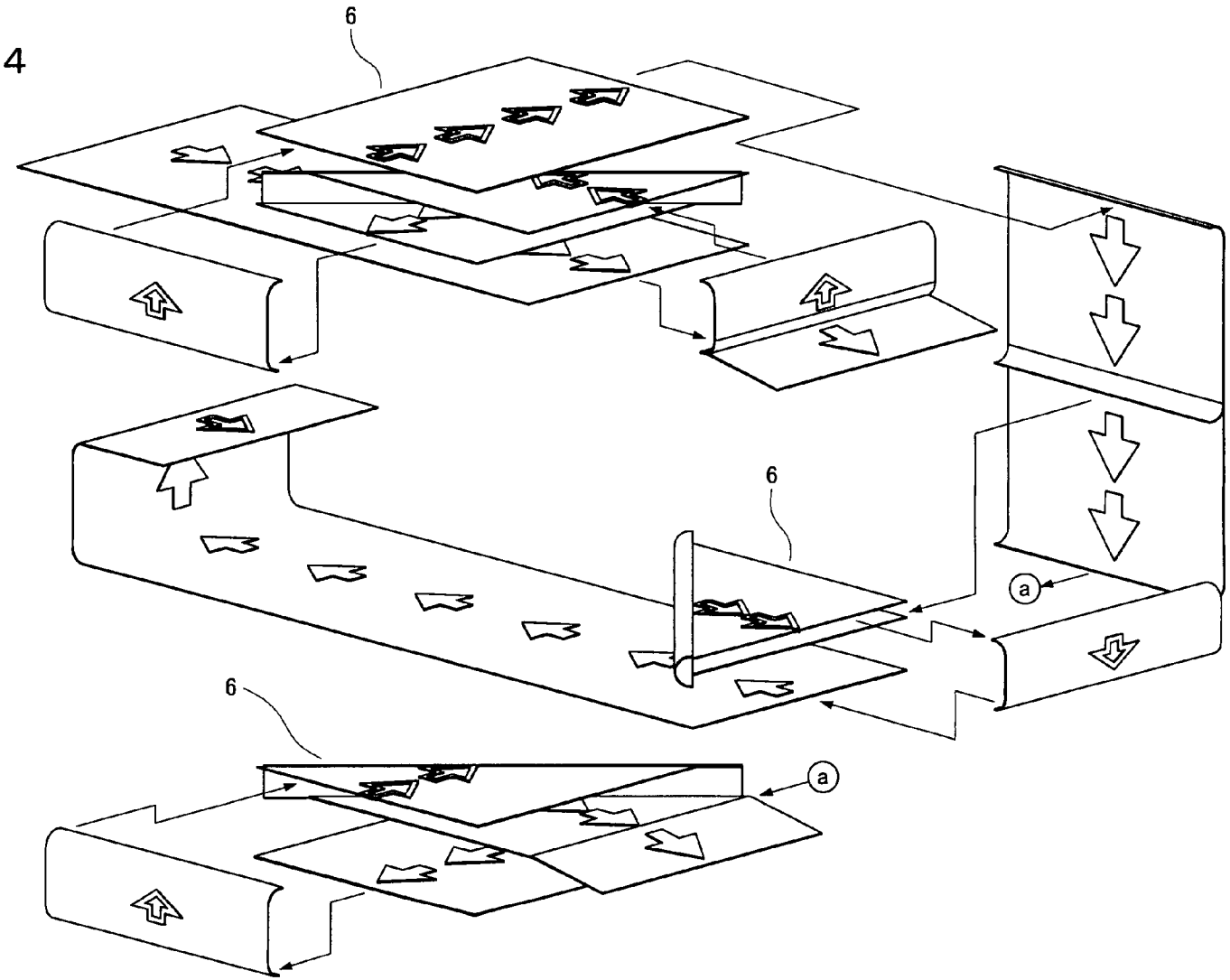
FIG. 24 is a schematic diagram showing the transport path of the sheet according to the embodiment of the present invention.

As shown in FIGS. 22 to 24, the paper feed mechanism 2 feeds sheets of paper one by one to the printer body 3. One side of the sheet is printed in the printer body 3 and the printed sheet is ejected to the paper receiving unit 7 through the paper inverting mechanism 4. When the sheet is ejected to the paper receiving unit 7 in the shortest time after the sheet is printed in the printer body 3, the sheet is passed through the inverting transfer unit 6 on the top stage of the paper inverting mechanism 4 without being inverted and then the sheet reaches the paper receiving unit 7.

After printed in the printer body 3, when the sheet of paper has to be kept in the paper inverting mechanism for a longer time to dry the printed surface of the sheet, the sheet is inverted by the inverting transfer unit 6 on the top stage of the paper inverting mechanism 4, is transferred to the inverting transfer unit 6 on the bottom stage, is inverted by the inverting transfer unit 6 on the bottom stage, and then reaches the lower paper receiving unit 7.

(Double-Sided Printing)

The paper feed mechanism 2 feeds sheets of paper one by one to the printer body 3. One side of the sheet is printed in the printer body 3. After printed in the printer body 3, the sheet is inverted in the inverting transfer unit 6 on the top stage of the paper inverting mechanism 4, is inverted by the inverting transfer unit 6 on the middle stage, and then is returned to the feed port of the printer body 3. After that, the other side of the sheet is printed in the printer body 3. After printed in the printer body 3, the sheet is inverted in the inverting transfer unit 6 on the top stage of the paper inverting mechanism 4, is transferred to the inverting transfer unit 6 on the bottom stage, is inverted by the inverting transfer unit 6 on the bottom stage, and then reaches the paper receiving unit 7 of the bottom stage.

Figure 25:
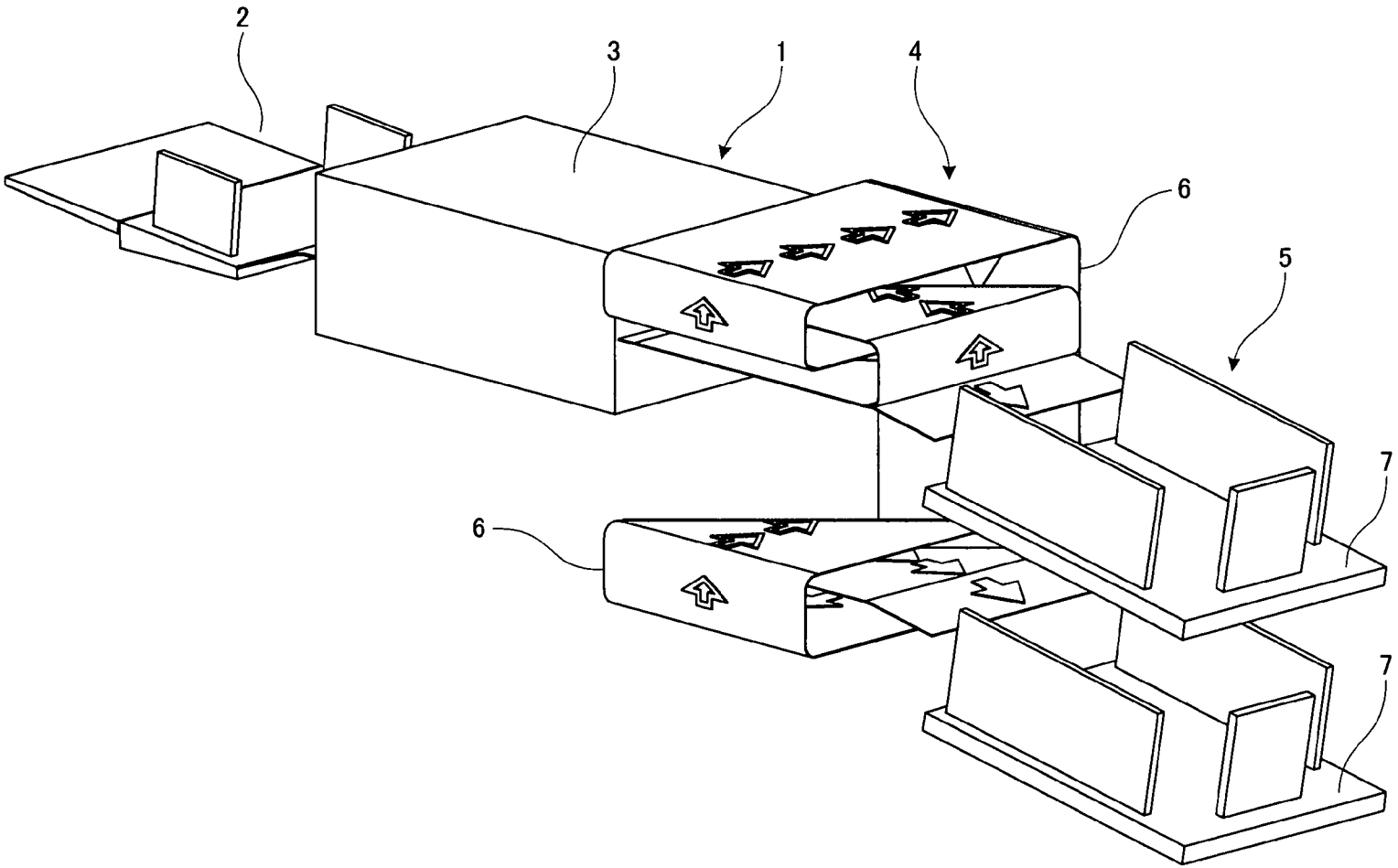
FIG. 25 is a schematic diagram showing a transport path of a sheet according to the embodiment of the present invention.
Figure 26:
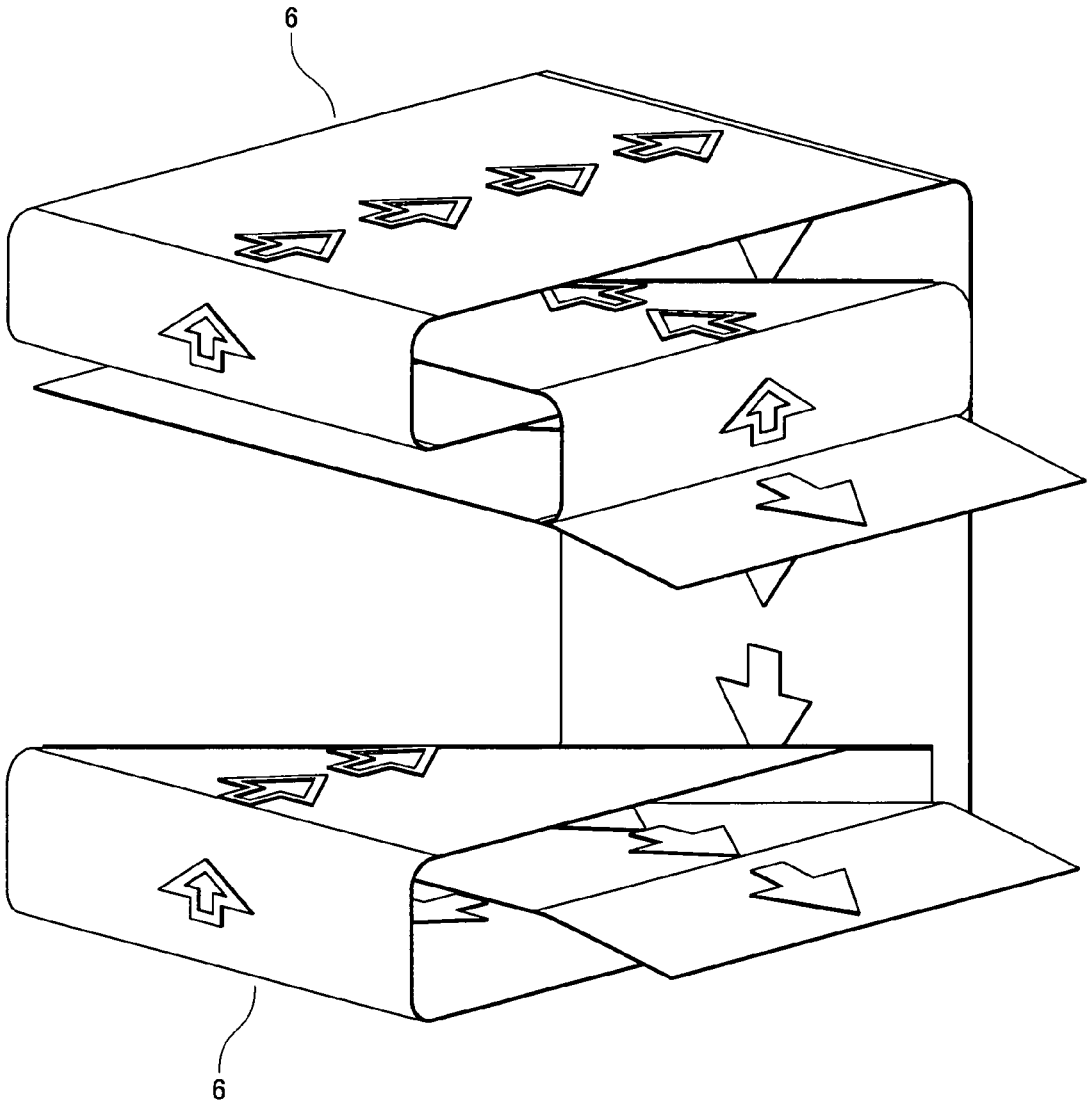
FIG. 26 is a schematic diagram showing the transport path of the sheet according to the embodiment of the present invention.
Figure 27:
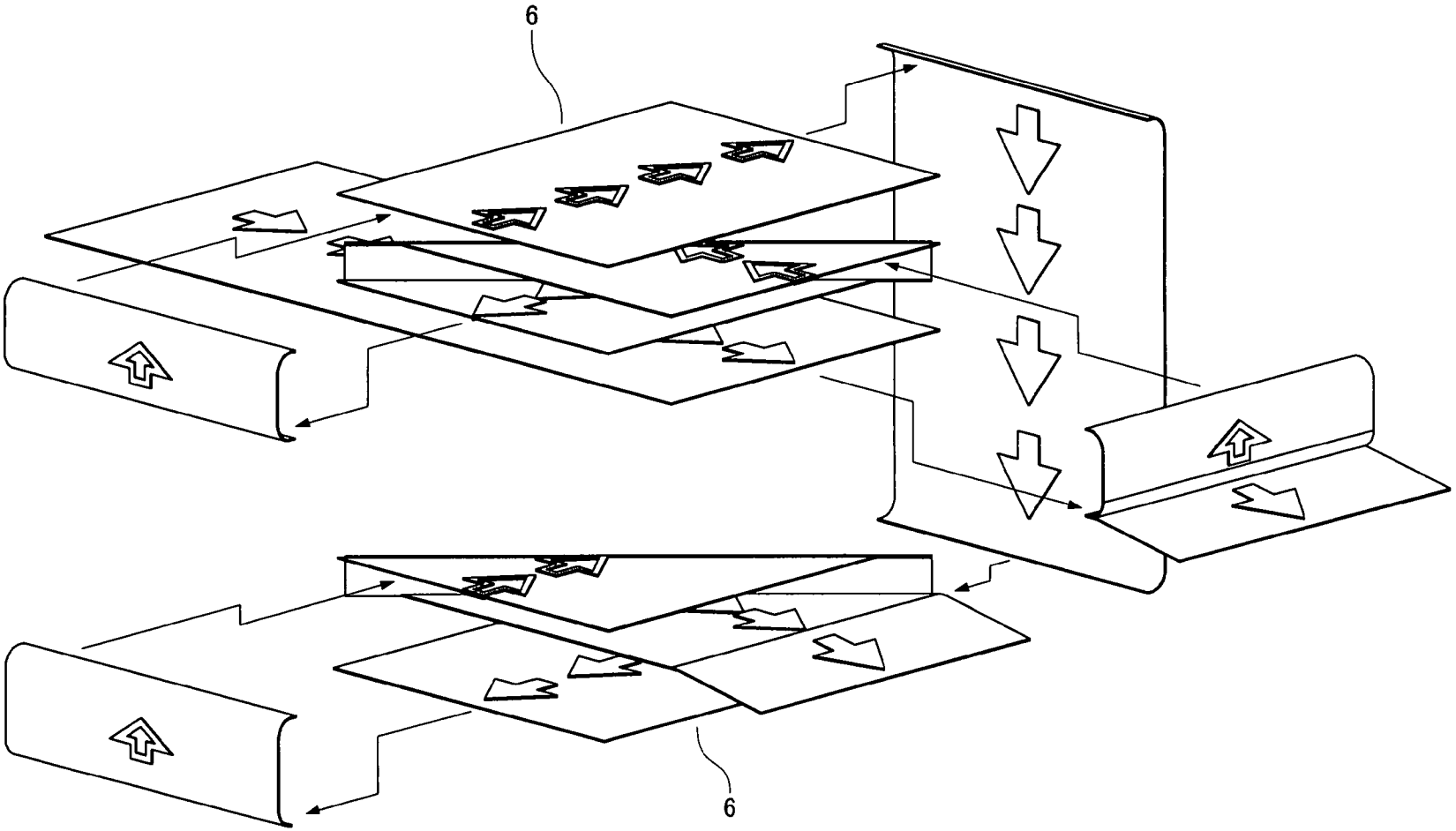
FIG. 27 is a schematic diagram showing the transport path of the sheet according to the embodiment of the present invention.

Referring to FIGS. 25 to 27, another application of the paper inverting device of the present invention will be described below.

(Overall Configuration)

In the following explanation, the same constituent elements as the constituent elements of the foregoing configuration are indicated by the same reference numerals. In this configuration, a paper inverting mechanism is a combination of upper and lower inverting transfer units 6 which can selectively form a plurality of transport paths.

(Single-Sided Printing)

As shown in FIGS. 25 to 27, a paper feed mechanism 2 feeds sheets of paper one by one to a printer body 3. One side of the sheet is printed in the printer body 3 and the printed sheet is ejected to a paper receiving unit 7 through a paper inverting mechanism 4. When the sheet is ejected to the paper receiving unit 7 in the shortest time after the sheet is printed in the printer body 3, the sheet is passed through the upper inverting transfer unit 6 of the paper inverting mechanism 4 without being inverted, and then the sheet reaches the paper receiving unit 7.

After printed in the printer body 3, when the sheet of paper has to be kept in the paper inverting mechanism 4 for a longer time to dry the printed surface of the sheet, the sheet is inverted by the upper inverting transfer unit 6 of the paper inverting mechanism 4, is transferred to the lower inverting transfer unit 6, is inverted by the lower inverting transfer unit 6, and then reaches the lower paper receiving unit 7.

Figure 1:
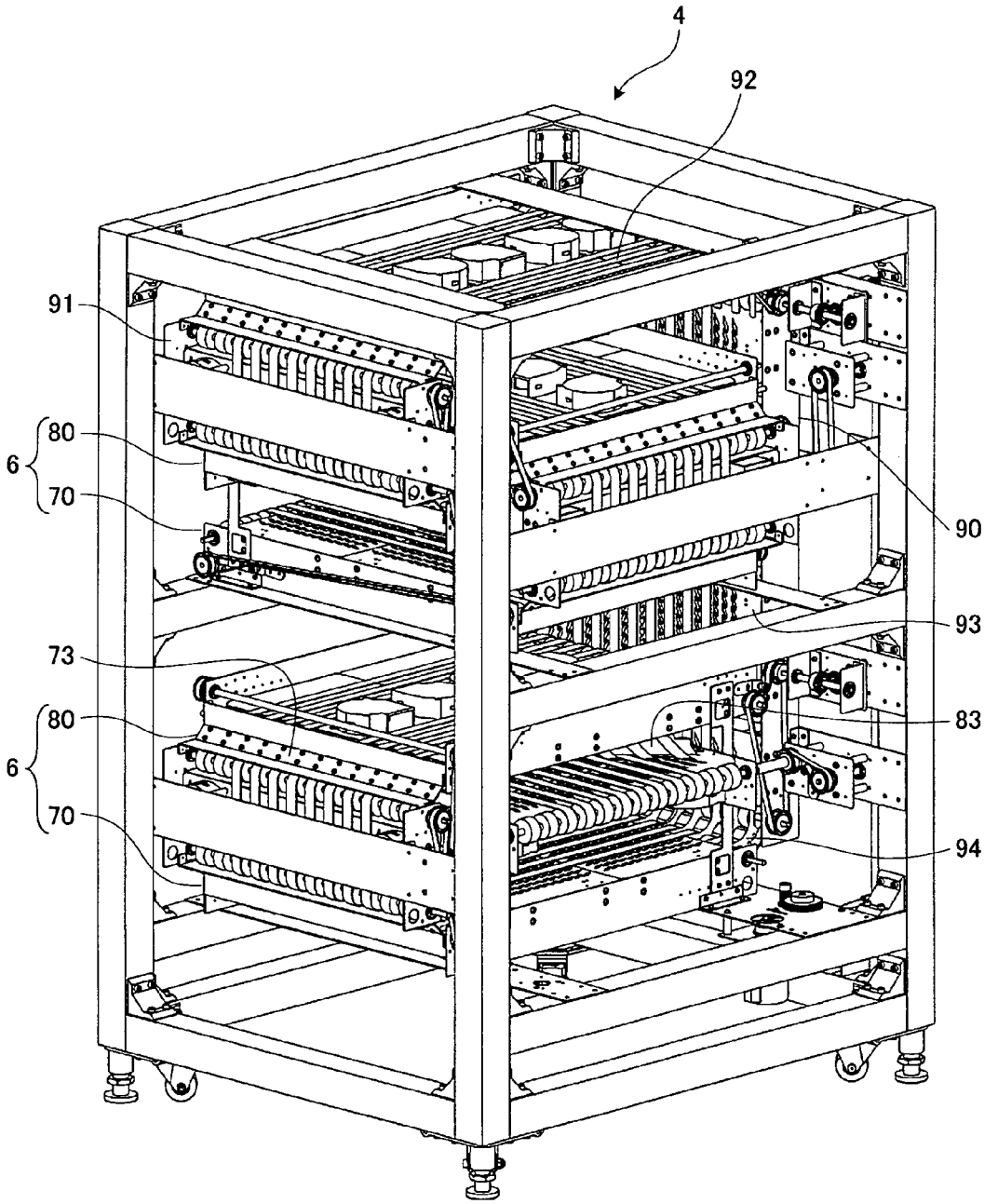
FIG. 1 is a perspective view showing a paper inverting device according to an embodiment of the present invention.

Referring to FIGS. 1 to 7, the paper inverting mechanism 4 of the present invention will be specifically described below. In FIG. 1, the paper inverting mechanism includes the plurality of inverting transfer units 6 which are vertically stacked. Each of the inverting transfer units 6 includes a first paper inverting device 70, a second paper inverting device 80, and a third paper inverting device 90 between the upper and lower inverting transfer units 6. The paper inverting mechanism 4 shown in FIGS. 1 to 7 does not have a mechanism of returning sheets of paper to the printer body 3 but such a mechanism can be easily realized according to the following explanation.

Figure 2:
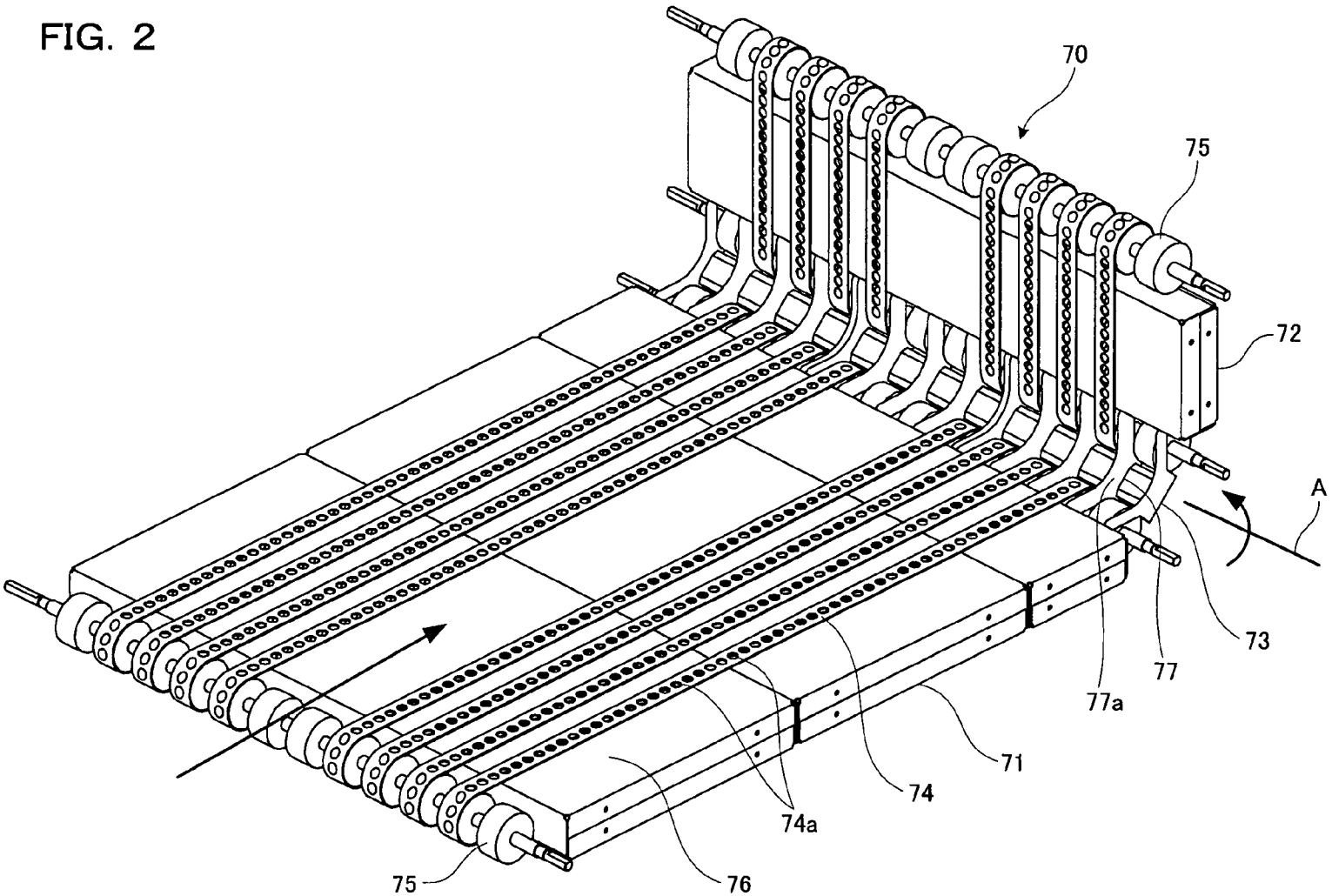
FIG. 2 is a perspective view showing a first paper inverting device according to the embodiment.

As shown in FIG. 2, the first paper inverting device includes a first transport device 71 forming a first transport surface on which a sheet of paper is transported in the horizontal direction, a second transport device 72 forming a second transport surface on which a sheet of paper is transported in a direction orthogonal to the first transport surface, and a turn guide 73 for inverting a sheet of paper around an inversion axis A by a predetermined inversion angle, in this case, by 90° when the sheet is transferred from the first transport surface to the second transport surface.

The first transport device 71 and the second transport device 72 include a plurality of transport belts 74 moving on transport paths along paper transport directions. The transport belts 74 are each made up of an endless belt looped over belt rollers 75 disposed on both ends of the transport path.

Figure 15:
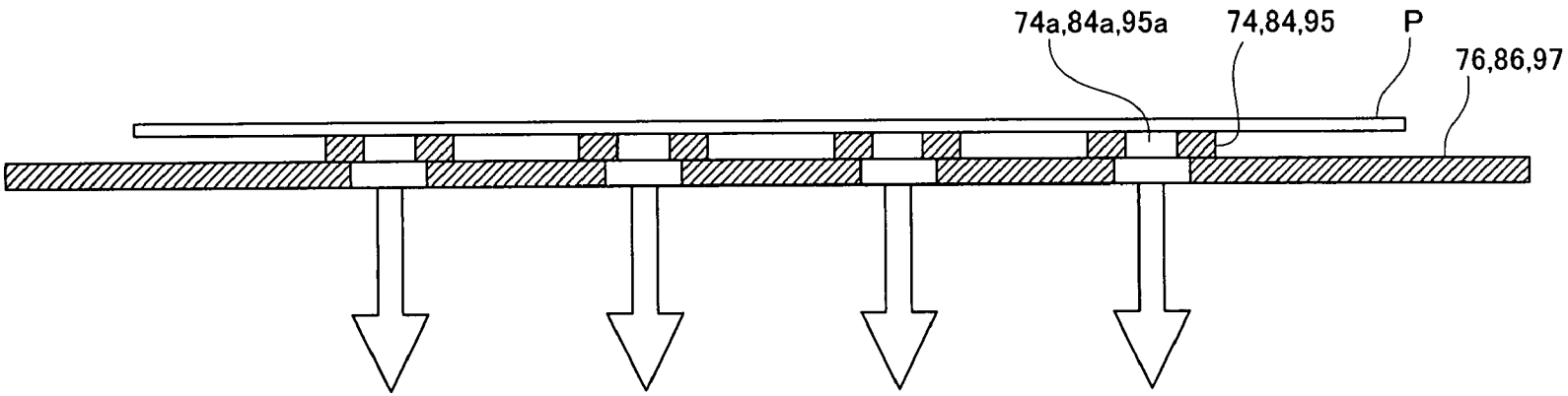
FIG. 15 is a sectional view showing a transport state in transport devices according to the embodiment of the present invention.
Figure 19:
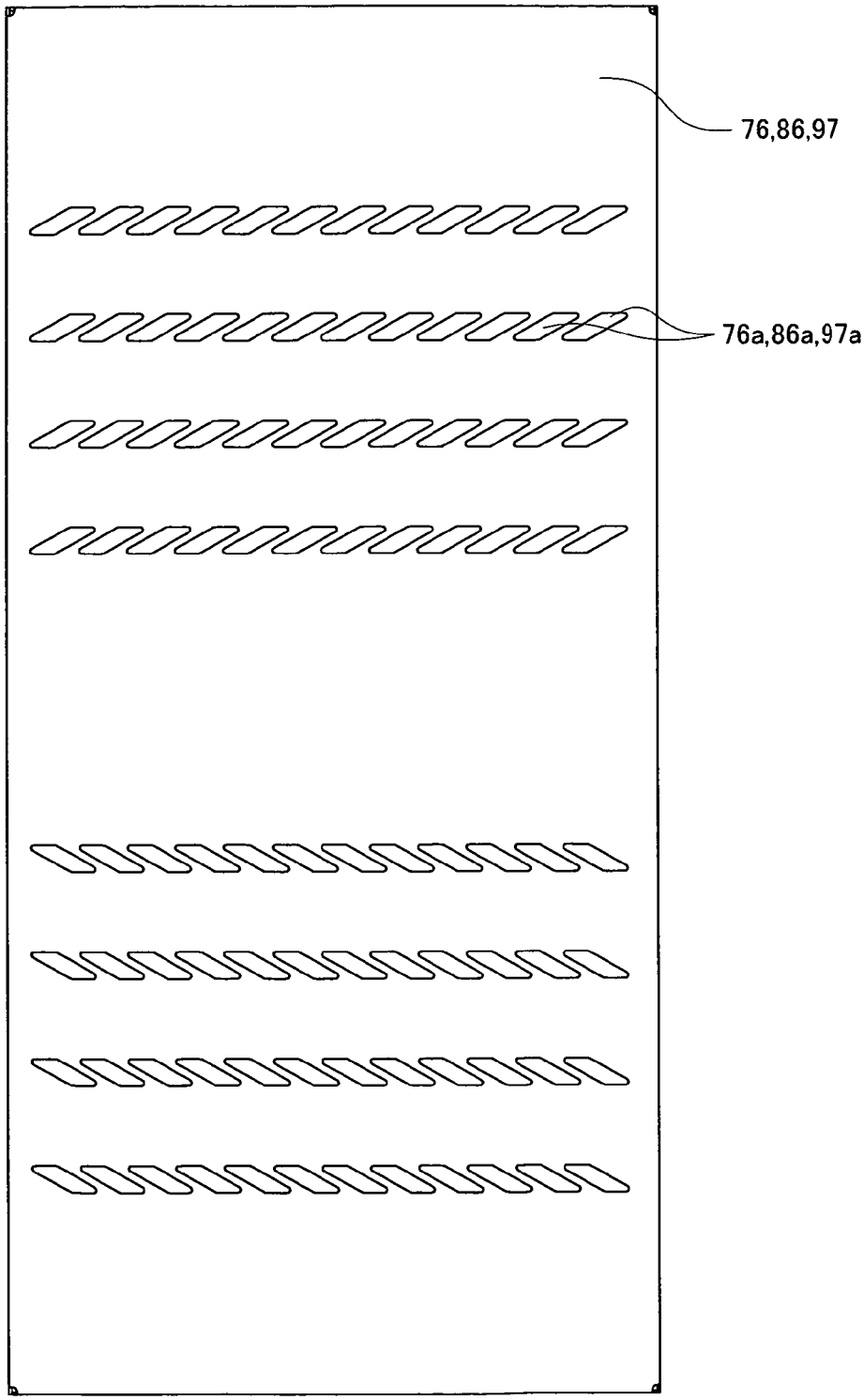
FIG. 19 is a schematic diagram showing the detail of the transport devices according to the embodiment of the present invention.

The transport paths are formed on suction boxes 76 acting as suction devices. The suction boxes 76 each communicate with an air suction source (not shown). As shown in FIG. 19, the suction box 76 has a plurality of openings 76*a* under the transport path. As shown in FIG. 15, the sheet P is sucked on the transport belts through suction holes 74*a* formed on the transport belts 74.

Figure 6:
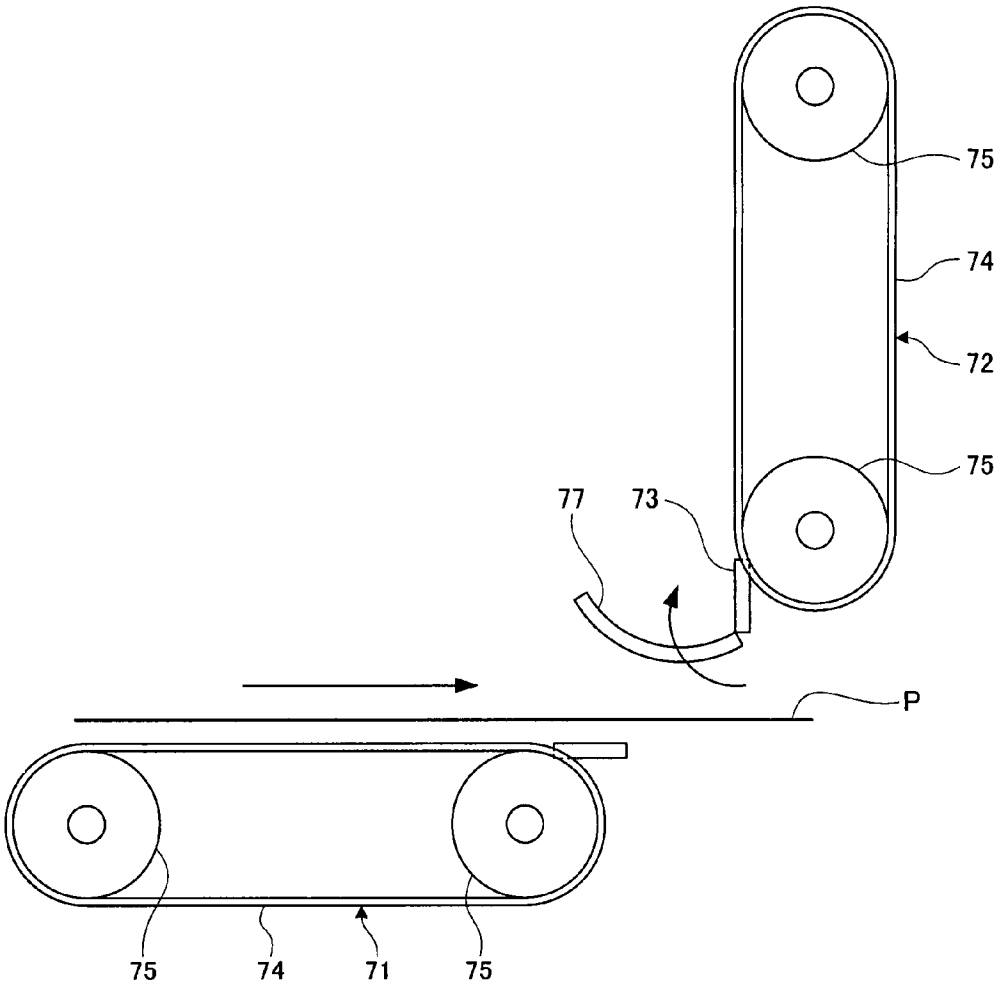
FIG. 6 is a side view showing the ejection mode state of the turn guide in the first paper inverting device according to the embodiment.
Figure 7:
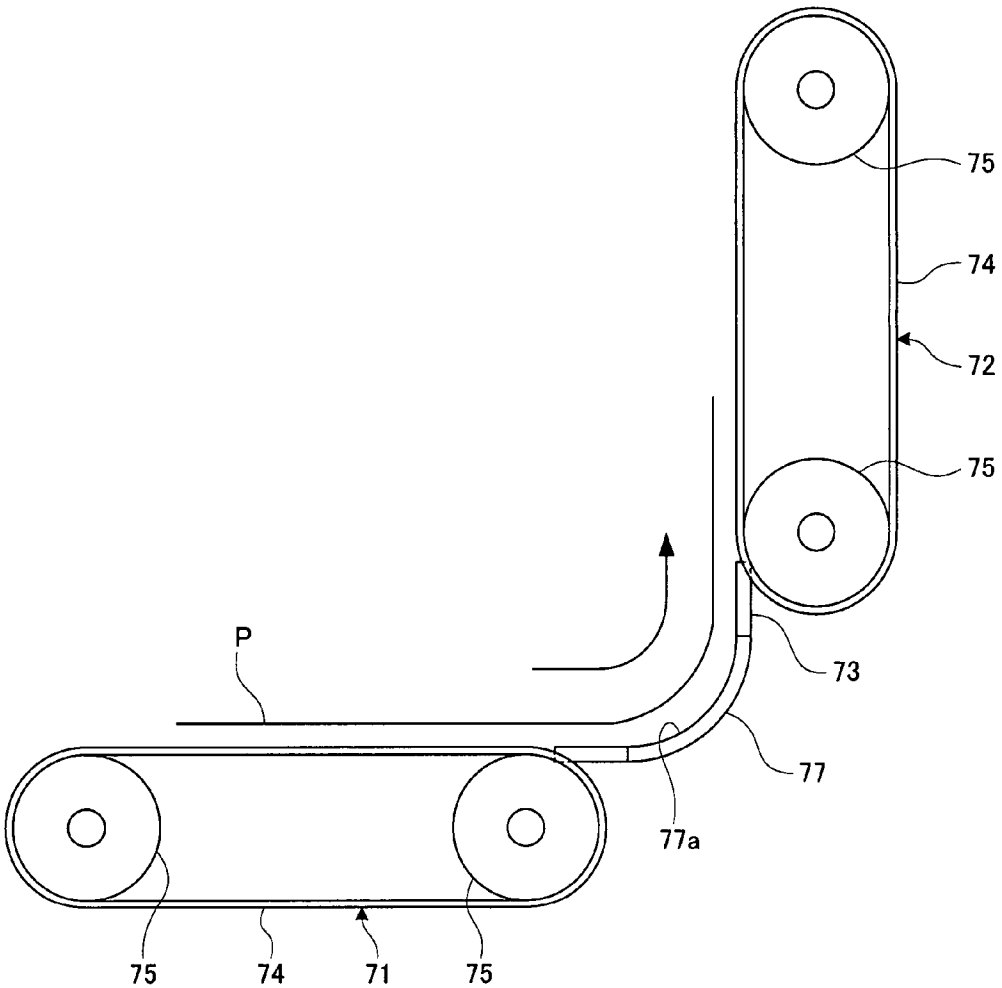
FIG. 7 is a side view showing the inversion mode state of the turn guide in the first paper inverting device according to the embodiment.

The turn guide 73 has a plurality of guide ribs 77 which are arranged along the inversion axis with a 20-mm to 50-mm pitch and are interposed between the transport belts 74. The guide ribs 77 which are in slidable contact with the sheet P have slidable contact portions forming curved inversion/transfer surfaces 77*a* from an inversion start point corresponding to the first transport surface to an inversion end point corresponding to the second transport surface. As shown in FIGS. 6 and 7, the guide ribs 77 can swing between a state in which the first transport surface and the second transport surface are connected to each other and a state in which the first transport surface and the second transport surface are separated from each other.

Figure 3:
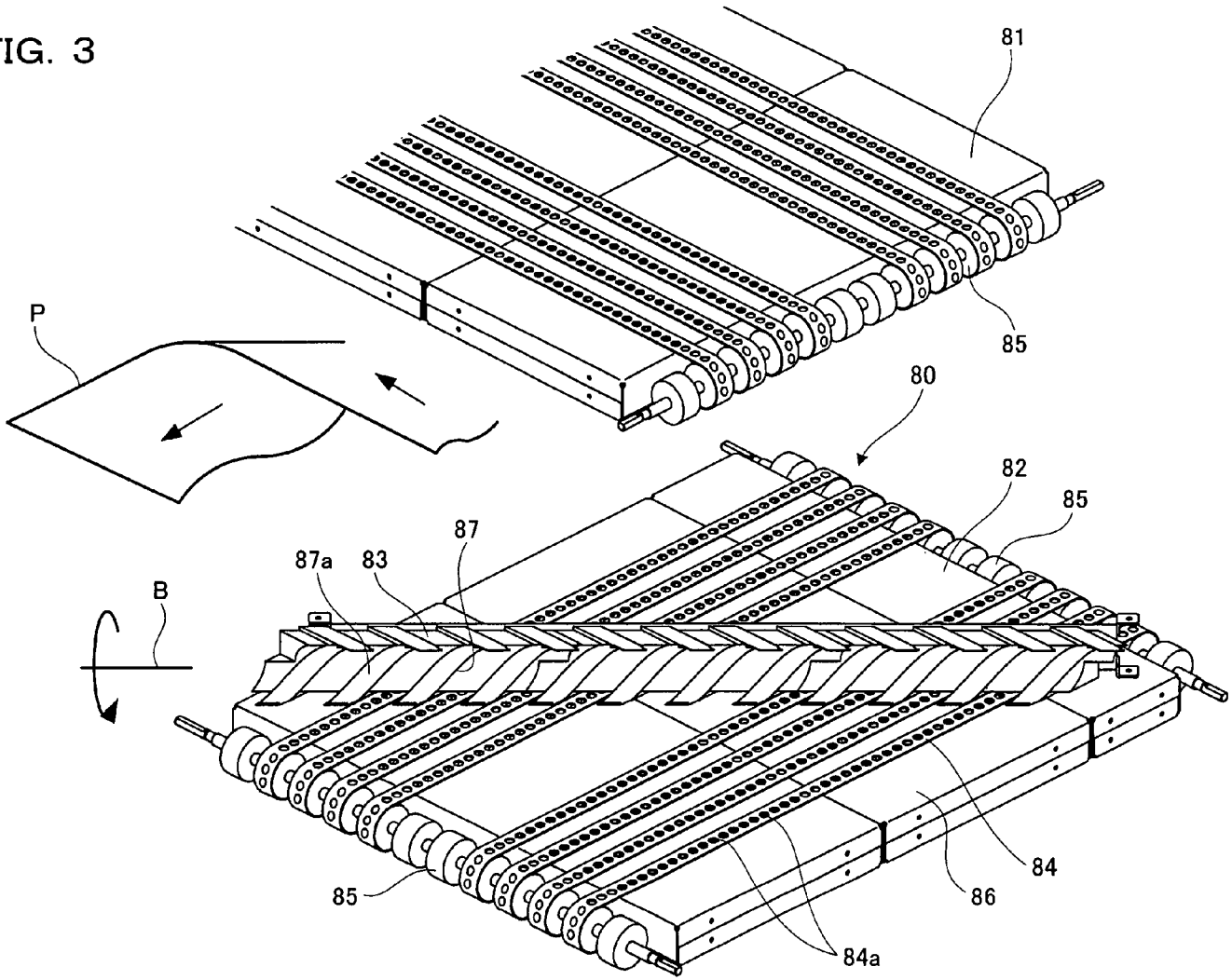
FIG. 3 is a perspective view showing a second paper inverting device according to the embodiment.

As shown in FIG. 3, the second paper inverting device 80 includes a first transport device 81 forming a first transport surface (face down) on which a sheet of paper is transported in the horizontal direction, a second transport device 82 forming a second transport surface (face up) which is opposed to the first transport surface and has a sheet transported in the horizontal direction, and a turn guide 83 which inverts the sheet P around an inversion axis B by a predetermined inversion angle, in this case, by 180° when the sheet P is transferred from the first transport surface to the second transport surface, and changes the transport direction of the sheet by a predetermined turning angle, in this case, by 90°.

The upper first transport device 81 and the lower second transport device 82 are disposed at relative positions where the paper transport directions are orthogonal to each other. At the relative positions, the inversion axis B of the sheet P is tilted by 45° relative to a direction orthogonal to the paper transport directions. The turn guide 83 is in parallel with the inversion axis B.

The first transport device 81 and the second transport device 82 include a plurality of transport belts 84 moving on transport paths along the paper transport directions. The transport belts 84 are each made up of an endless belt looped over belt rollers 85 disposed on both ends of the transport paths.

The transport paths are formed on suction boxes 86 acting as suction devices. The suction boxes 86 each communicate with an air suction source (not shown). As shown in FIG. 19, the suction box 86 has a plurality of openings 86*a* under the transport path. As shown in FIG. 15, the sheet P is sucked on the transport belts through suction holes 84*a* formed on the transport belts 84.

The turn guide 83 has a plurality of guide ribs 87 which are arranged with a predetermined pitch along the inversion axis B, have a center distance of 20 mm to 50 mm in a direction orthogonal to the paper transport direction, and are interposed between the transport belts 84. The guide ribs 87 which are in slidable contact with the sheet P have slidable contact portions forming curved inversion/transfer surfaces 87*a* from an inversion start point corresponding to the first transport surface to an inversion end point corresponding to the second transport surface. On the inversion start point, the inversion/transfer surfaces 87*a* are directed to the paper transport direction of the first transport device 81. On the inversion end point, the inversion/transfer surfaces 87*a* are directed to the paper transport direction of the second transport device 82. Thus the inversion/transfer surfaces 87*a* are twisted by 90° between the inversion start point and the inversion end point (see FIGS. 4 and 5).

The third paper inverting device 90 is configured as the first paper inverting device 70. One end of the third paper inverting device 90 is connected to the second transport device 82 of the second paper inverting device 80 of the upper inverting transfer unit 6 and the other end of the third paper inverting device 90 is connected to the first transport device 71 of the first paper inverting device 70 of the lower inverting transfer unit 6.

In the present embodiment, the third paper inverting device 90 includes a first transport device 91 forming a first transport surface on which a sheet is transported in the vertical direction, a second transport device 92 forming a second transport surface on which a sheet is transported in the horizontal direction, a third transport device 93 forming a third transport surface on which a sheet is transported in the vertical direction, and a turn guide 94 which inverts a sheet of paper around an inversion axis by a predetermined inversion angle, in this case, by 90°. The first transport device 91 is connected to the upper inverting transfer unit 6 and the third transport device 93 is connected to the lower inverting transfer unit 6.

The first transport device 91, the second transport device 92, and the third transport device 93 include a plurality of transport belts 95 moving on transport paths along the paper transport directions. The transport belts 95 are each made up of an endless belt looped over belt rollers 96 disposed on both ends of the transport paths.

The transport paths are formed on suction boxes 97 acting as suction devices. The suction boxes 97 each communicate with an air suction source (not shown). As shown in FIG. 19, the suction box 97 has a plurality of openings 97*a* under the transport path. As shown in FIG. 15, the sheet P is sucked on the transport belts through suction holes 95*a* formed on the transport belts 95.

The turn guide 94 is identical to the turn guide 73 of the first paper inverting device 70 and thus the explanation thereof is omitted.

Figure 17A:
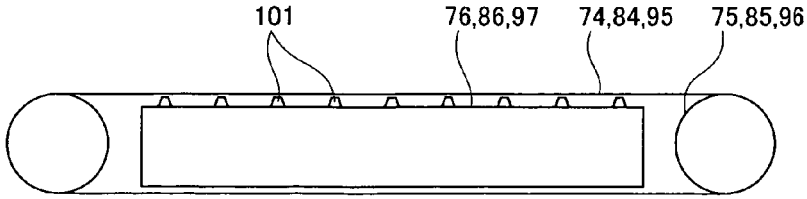
FIG. 17 is a schematic diagram showing the detail of the transport devices according to the embodiment of the present invention.
Figure 17B:
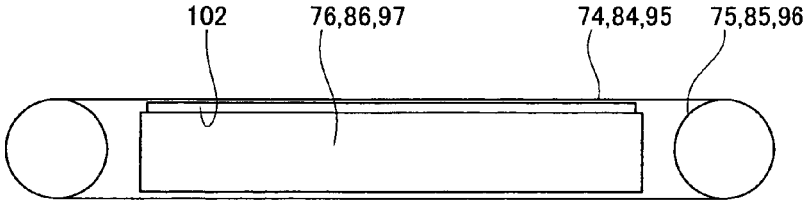
Figure 17C:
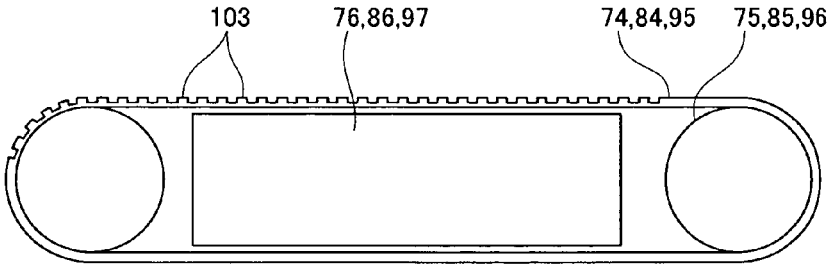
Figure 17D:
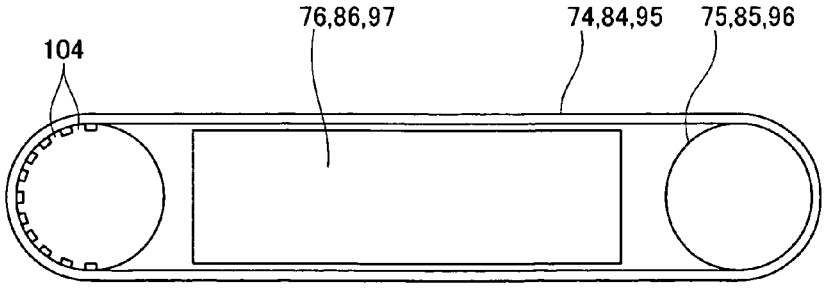
Figure 18A:
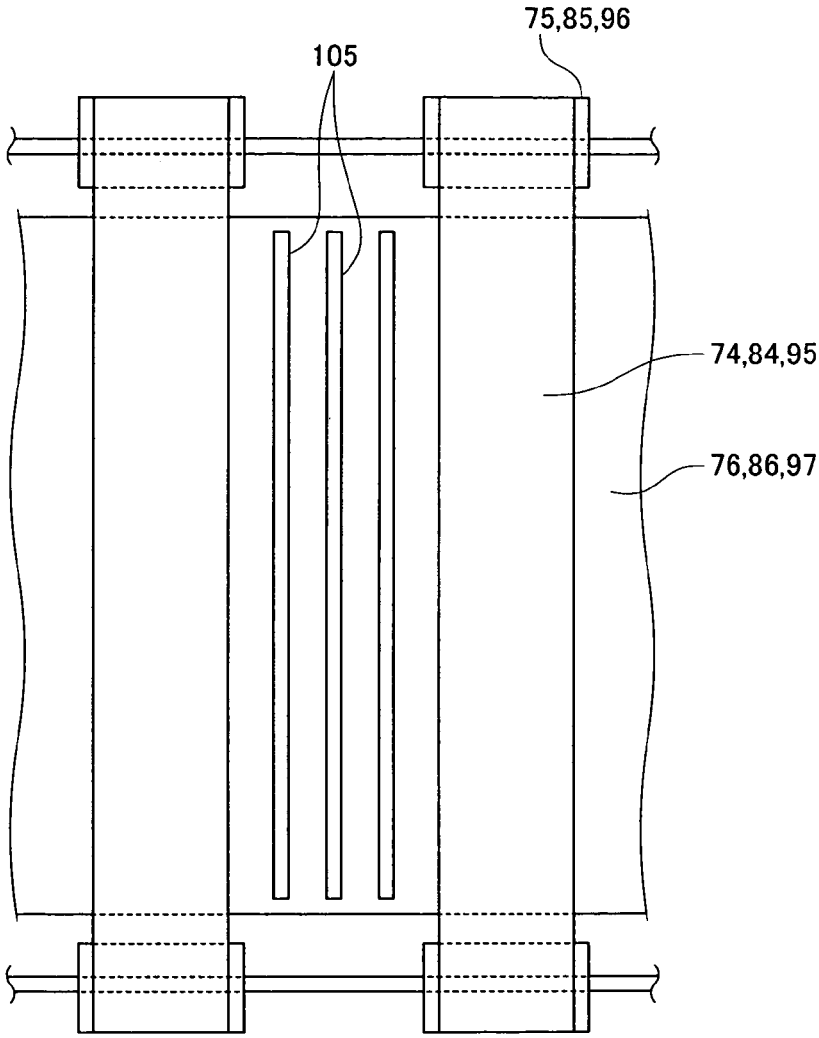
FIG. 18 is a schematic diagram showing the detail of the transport devices according to the embodiment of the present invention.
Figure 18B:
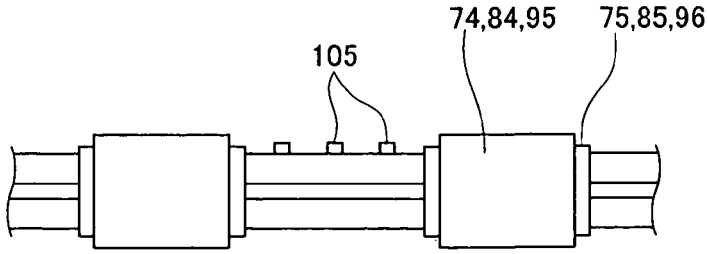

As shown in FIG. 17A, the transport devices 71, 72, 81, 82, 91, 92 and 93 may include a plurality of protrusions 101 formed as low-friction members on portions where the transport belts 74, 84 and 95 slide. Alternatively, a low-friction member 102 may be provided as shown in FIG. 17B. As shown in FIG. 17C, the transport belts 74, 84 and 95 have a plurality of protrusions 103 formed on the surfaces coming into contact with a sheet of paper. As shown in FIG. 17D, the belt rollers 75, 85 and 96 for driving the transport belts 74, 84 and 95 have a plurality of protrusions 104 formed on portions pressed to the transport belts. As shown in FIGS. 18A and 18B, the transport devices 71, 72, 81, 82, 91, 92 and 93 include a plurality of ribs 105 acting as paper support members between the transport belts 74, 84 and 95.

The ribs 105 are as high as or lower than the surfaces of the transport belts on the transport path. On a position corresponding to the inversion start point of the turn guide, the ribs 105 are higher than the inversion/transfer surfaces. On a position corresponding to the inversion end point of the turn guide, the ribs 105 are lower than the inversion/transfer surfaces. The corners of the top surfaces of the ribs coming into contact with a sheet of paper are disposed along the paper transport direction and the corners are preferably curved to prevent a scratch on the sheet.

The operation of the aforementioned configuration will be described below. The sheet P having one side printed by the printer body 3 enters the upper inverting transfer unit 6 of the paper inverting mechanism 4 and reaches the start end of the first transport device 71 of the first paper inverting device 70. As shown in FIG. 15, the first transport device 71 sucks on the transport belts the opposite side of the sheet P from the printed surface through the suction holes 74*a* formed on the transport belts 74, by means of the suction box 76. In this state, as shown in FIG. 2, the transport belts 74 move on the transport path with the sheet, so that the sheet P is transported in the paper transport direction on the first transport surface.

When the sheet P is ejected to the paper receiving unit 7 through the paper inverting mechanism 4 in the shortest time, as shown in FIG. 6, the guide ribs 77 of the turn guide 73 are operated so as to separate the first transport surface and the second transport surface, and then the sheet P is ejected from the first transport device 71 to the paper receiving unit 7.

After printed in the printer body 3, when the sheet P has to be kept in the paper inverting mechanism 4 for a longer time to dry the printed surface of the sheet, as shown in FIG. 7, the guide ribs 77 of the turn guide 73 are operated so as to connect the first transport surface and the second transport surface.

This configuration can be provided at a certain point of the third transport device 93 to switch, when a mechanism is provided to return the sheet to the printer body 3, a state in which the sheet is introduced into the mechanism and a state in which the sheet is not introduced into the mechanism.

As shown in FIG. 2, when the first transport device 71 transports the sheet P in the paper transport direction on the first transport surface, the sheet P reaches the turn guide 73, and then the end of the sheet enters the inversion/transfer surfaces 77*a* from the inversion start point of the turn guide 73, as the sheet P moves in the paper transport direction, the guide ribs 77 guide the end of the sheet with the inversion/transfer surfaces 77*a*, the back side of the sheet P comes into slidable contact with the inversion/transfer surfaces 77*a*, and the surfaces of the sheet P are inverted and curved along the inversion/transfer surfaces 77*a*, following the end of the sheet. In this case, the sheet P is inverted by 90°.

When the sheet P reaches the second transport device 72 and the end of the sheet enters the second transport surface from the inversion end points of the inversion/transfer surfaces 77*a* of the guide ribs 77 on the turn guide 73, the second transport device 72 sucks on the transport belts the opposite side of the sheet P from the printed surface through the suction holes 74*a* formed on the transport belts 74, by means of the suction boxes 76. The transport belts 74 move on the transport paths with the sheet P, so that the sheet P is transported in the paper transport direction on the second transport surface. At this point, the first transport device 71 transports the sheet P until the rear end of the sheet reaches the inversion start point of the turn guide 73.

When the sheet P reaches the terminal end of the second transport device 72, one end of the sheet enters a turn guide (identical to the turn guide 73 and not shown in FIG. 2), is inverted by 90° as in the foregoing operation, and enters the second paper inverting device 80.

As shown in FIG. 3, in the second paper inverting device 80, the first transport device 81 sucks the opposite side of the sheet P from the printed surface through the suction holes 84*a* formed on the transport belts 84, on the transport belts by means of the suction boxes 86. The transport belts 84 move on the transport path with the sheet P, so that the sheet P is transported in the paper transport direction on the first transport surface.

When the sheet P reaches the turn guide 83 and one end of the sheet P enters the inversion/transfer surfaces 87*a* from the inversion start point of the turn guide 83, the guide ribs 87 guide the end of the sheet with the inversion/transfer surfaces 87*a* as the sheet P moves in the paper transport direction, the back side of the sheet P comes into slidable contact with the inversion/transfer surfaces 87*a*, and the surfaces of the sheet P are inverted and curved along the inversion/transfer surfaces 87*a*, following the end of the sheet. In this case, the sheet is inverted by 180°.

At this point, the upper first transport device 81 and the lower second transport device 82 are disposed at relative positions where the paper transport directions are orthogonal to each other. The inversion axis B of the sheet P is tilted at the relative positions by 45° relative to a direction orthogonal to the paper transport direction and the turn guide 83 is disposed in parallel with the inversion axis B.

Therefore, one corner of the end of the sheet P first reaches the turn guide 83 and then the end of the sheet enters the inversion/transfer surfaces 87*a* from the corner of the end. The entry of the end of the sheet P to the inversion/transfer surfaces 87*a* is delayed as being close to the other corner of the end of the sheet P. The sheet P is first inverted from the corner having first entered the inversion/transfer surfaces 87*a* and the start of the inversion is delayed as being close to the other corner of the end of the sheet P, so that the transport direction of the sheet P is changed.

In other words, when the sheet P is transferred from the first transport surface to the second transport surface, the turn guide 83 inverts the sheet P by the predetermined inversion angle around the inversion axis tilted by a predetermined angle of 45° relative to a direction orthogonal to the paper transport direction of the first transport device 81, so that the transport direction of the sheet P is changed by a predetermined turning angle of 90°.

Figure 4:
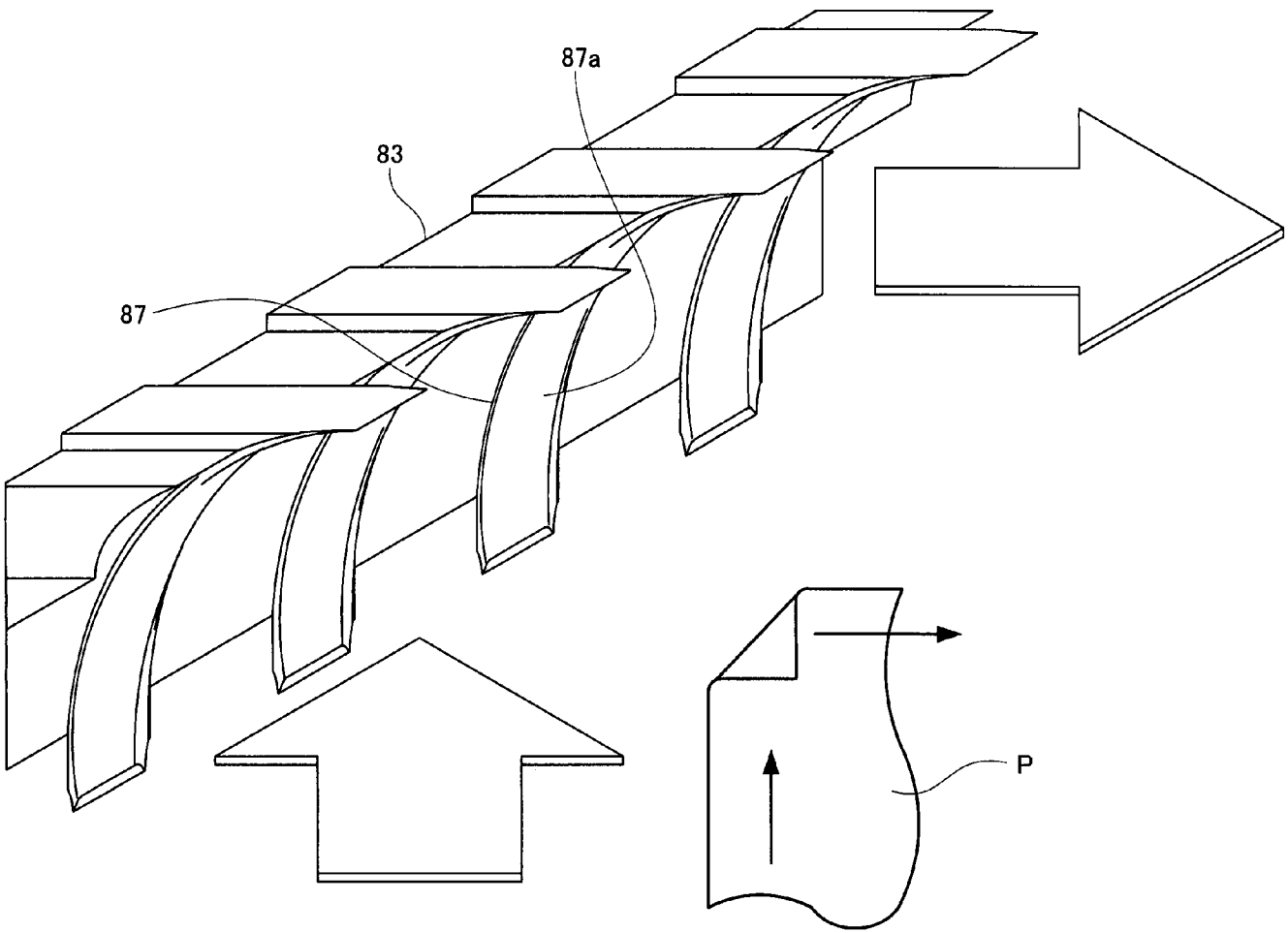
FIG. 4 is a perspective view showing a turn guide in the second paper inverting device according to the embodiment.
Figure 5:
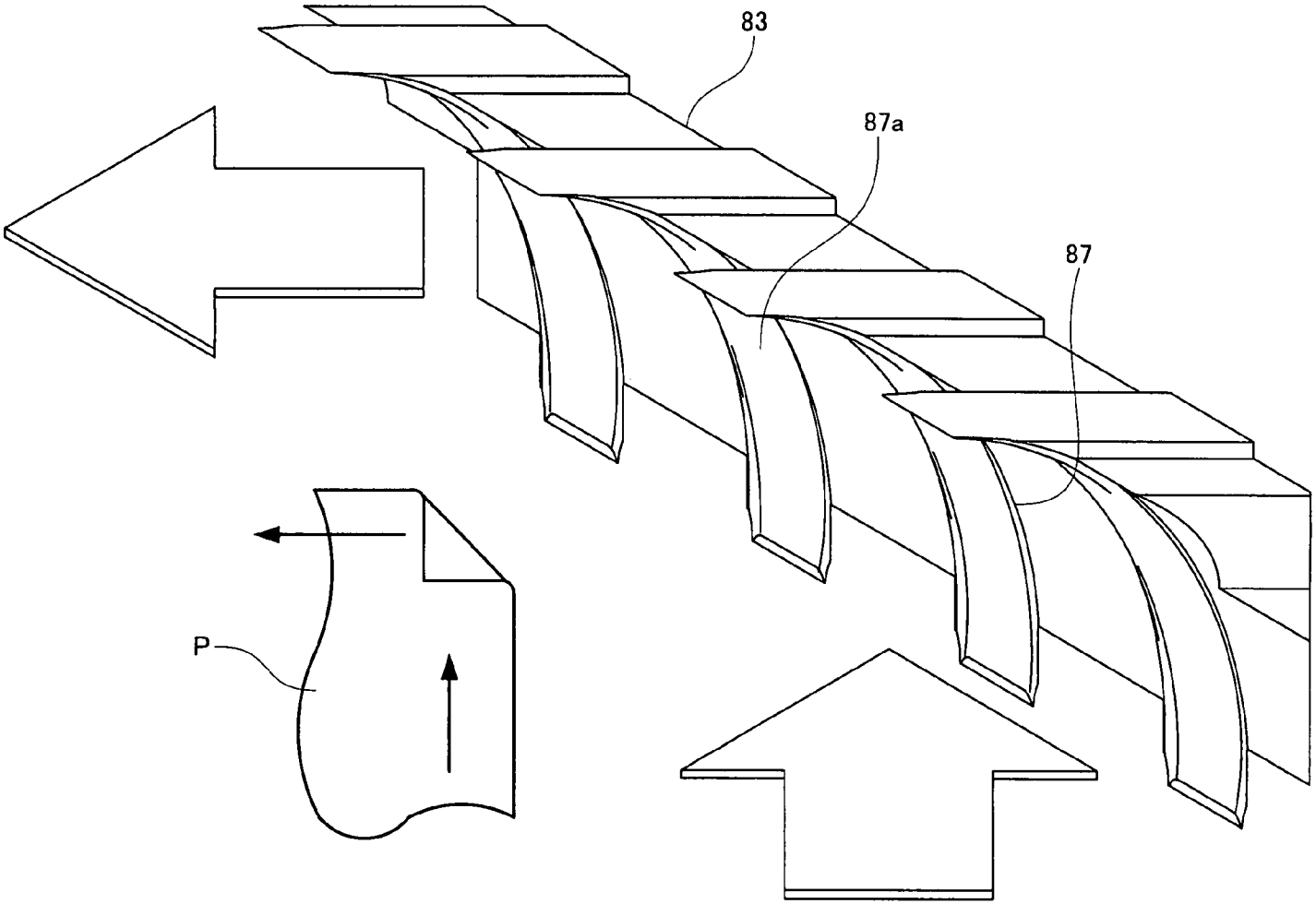
FIG. 5 is a perspective view showing another turn guide in the second paper inverting device according to the embodiment.

FIG. 4 shows the shape of the turn guide 83 when the paper transport direction is changed to the right by 90° and is inverted by 180°. FIG. 5 shows the shape of the turn guide 83 when the paper transport direction is changed to the left by 90° and is inverted by 180°.

When the sheet P reaches the second transport device 82 and the end of the sheet enters the second transport surface from one corner of the end, the second transport device 82 transports the sheet P in the paper transport direction on the second transport surface. At this point, on the second transport surface, the sheet P returns to a position where the end is in parallel with a direction orthogonal to the paper transport direction.

When the sheet P reaches the terminal end of the second transport device 82, one end of the sheet enters a turn guide (identical to the turn guide 73 and not shown in FIG. 3), is inverted by 90° as in the foregoing operation, and enters the third paper inverting device 90.

The third paper inverting device 90 repeatedly inverts the sheets P by 90° while transporting the sheets P by the same operation as the first paper inverting device 70, and feeds the sheets P to the first transport device 71 of the first paper inverting device 70 in the lower inverting transfer unit 6.

As has been discussed, the sheet P is inverted and the transport direction is changed in the upper inverting transfer unit 6 of the paper inverting mechanism 4, the sheet P is transferred to the lower inverting transfer unit 6, and then the sheet P is inverted and the transport direction is changed in the lower inverting transfer unit 6 as in the upper inverting transfer unit 6. After that, the sheet P is ejected to the paper receiving unit 7.

When paper powder from the transported sheet P falls between the transport belts 74, 84 and 95 and the sheet P sucked on the transport belts, the sheet P may slide. However, by collecting paper powder between the plurality of protrusions 103 provided on the transport belts 74, 84 and 95, it is possible to prevent the paper powder from falling between the transport belts 74, 84 and 95 and the sheet P, so that the sheet can be reliably transported. Further, by engaging the rear end of the sheet onto the protrusions 103 of the transport belts 74, 84 and 95, the sheet P can be reliably pressed and transported.

Further, when paper powder falls between the transport belts 74, 84 and 95 and the belt rollers 75, 85 and 96, the transport belts 74, 84 and 95 may slide. However, by collecting paper powder between the plurality of protrusions 104 provided on the belt rollers 75, 85 and 96, it is possible to prevent the paper powder from falling between the belt rollers 75, 85 and 96 and the transport belts 74, 84 and 95, so that the transport belts 74, 84 and 95 can be reliably driven.

It is preferable that the protrusions 103 provided on the transport belts 74, 84 and 95 are 0.5 mm or less in height. When the heights of the protrusions exceed 0.5 mm, air leaks between the protrusions 103 and the suction force is reduced, so that the sheet P may not be sufficiently sucked.

Figure 16:
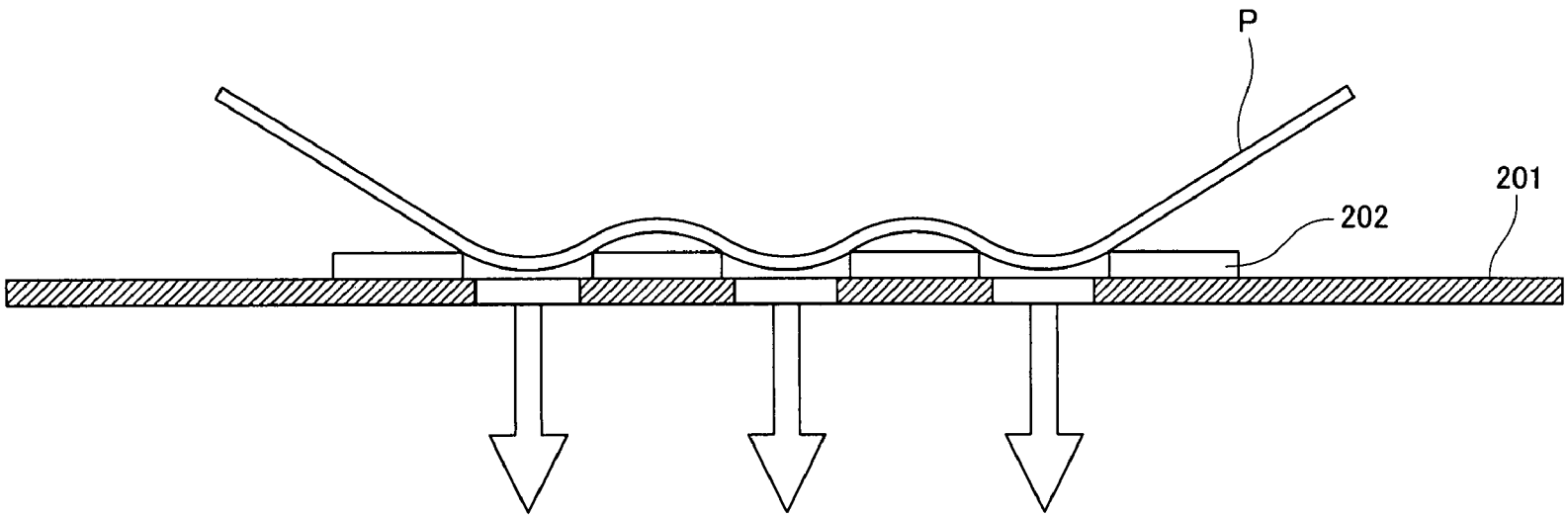
FIG. 16 PRIOR ART
FIG. 16 is a sectional view showing a transport state in a transport device of the prior art.

As shown in FIG. 16, in a configuration where a suction box 201 sucks the sheet P between transport belts 202, the sheet P enters between the transport belts 202 and dents are formed on the sheet P. On the reverse side of the sheet P, protrusions are formed between the transport belts 202 and the sheet P is wrinkled.

However, in the present embodiment, as shown in FIG. 15, the first transport devices 71, 81 and 91 and the second transport devices 72, 82 and 92 of the first to third paper inverting devices 70, 80 and 90 and the third transport device 93 of the third paper inverting device 90 suck on the transport belts the opposite side of the sheet P from the printed surface through the suction holes 74*a*, 84*a* and 95*a* formed on the transport belts 74, 84 and 95, by means of the suction boxes 76, 86 and 97. The transport belts 74, 84 and 95 move on the transport path with the sheet P, so that the sheet P is transported in the paper transport direction on the first transport surface. Thus it is possible to prevent a deformation of the sheet P. Further, the sheet P is supported by the ribs 105 between the transport belts to prevent a deformation of the sheet P, thereby preventing wrinkles when the sheet P is inverted.

Moreover, the diameters of the suction holes 74*a*, 84*a* and 95*a* of the transport belts 74, 84 and 95 are estimated at least 5 mm to obtain a suction force allowing the transport belts 74, 84 and 95 to securely hold the sheet P at the suction holes 74*a*, 84*a* and 95*a*. When the suction holes 74*a*, 84*a* and 95*a* are formed at the centers of the transport belts 74, 84 and 95, it is preferable to leave at least a 5-mm width on each side of the suction holes 74*a*, 84*a* and 95*a* in consideration of the strengths of the belts. As a result, the belts have to be at least 15 mm in width. Moreover, the guide ribs have to be at least 2 mm in width in order to sufficiently hold the underside of the sheet.

As has been discussed, it is most preferable that the guide ribs have a center distance of at least 20 mm in a direction orthogonal to the paper transport direction, in consideration of gaps between the guide ribs and the transport belts. When spacing between the guide ribs is too large, the end of the sheet is likely to be inserted between the guide ribs. Thus it is preferable to suppress the center distance between the guide ribs to 50 mm or less according to test results.

Figure 8:
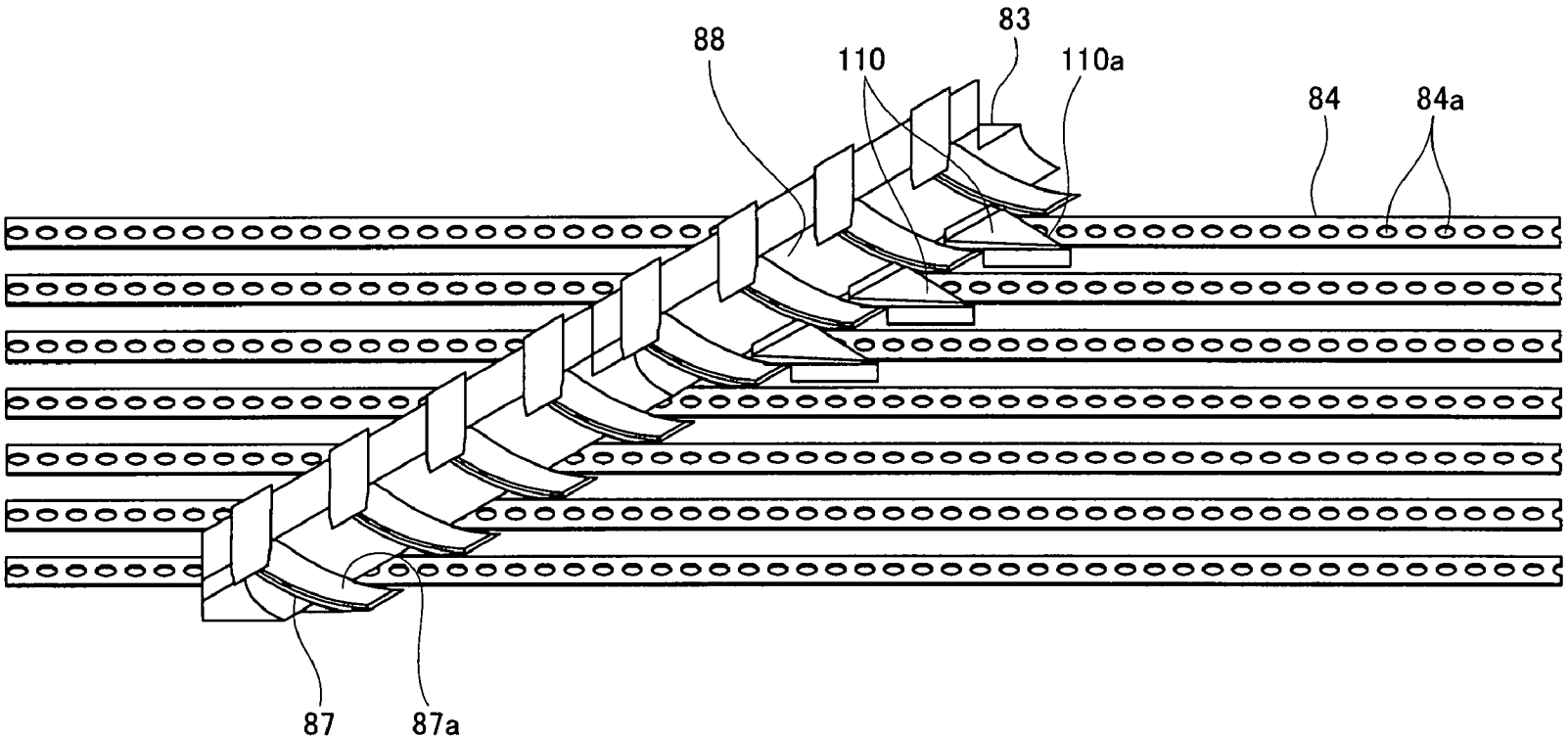
FIG. 8 is a perspective view showing a turn guide in a second paper inverting device according to another embodiment of the present invention.
Figure 9:
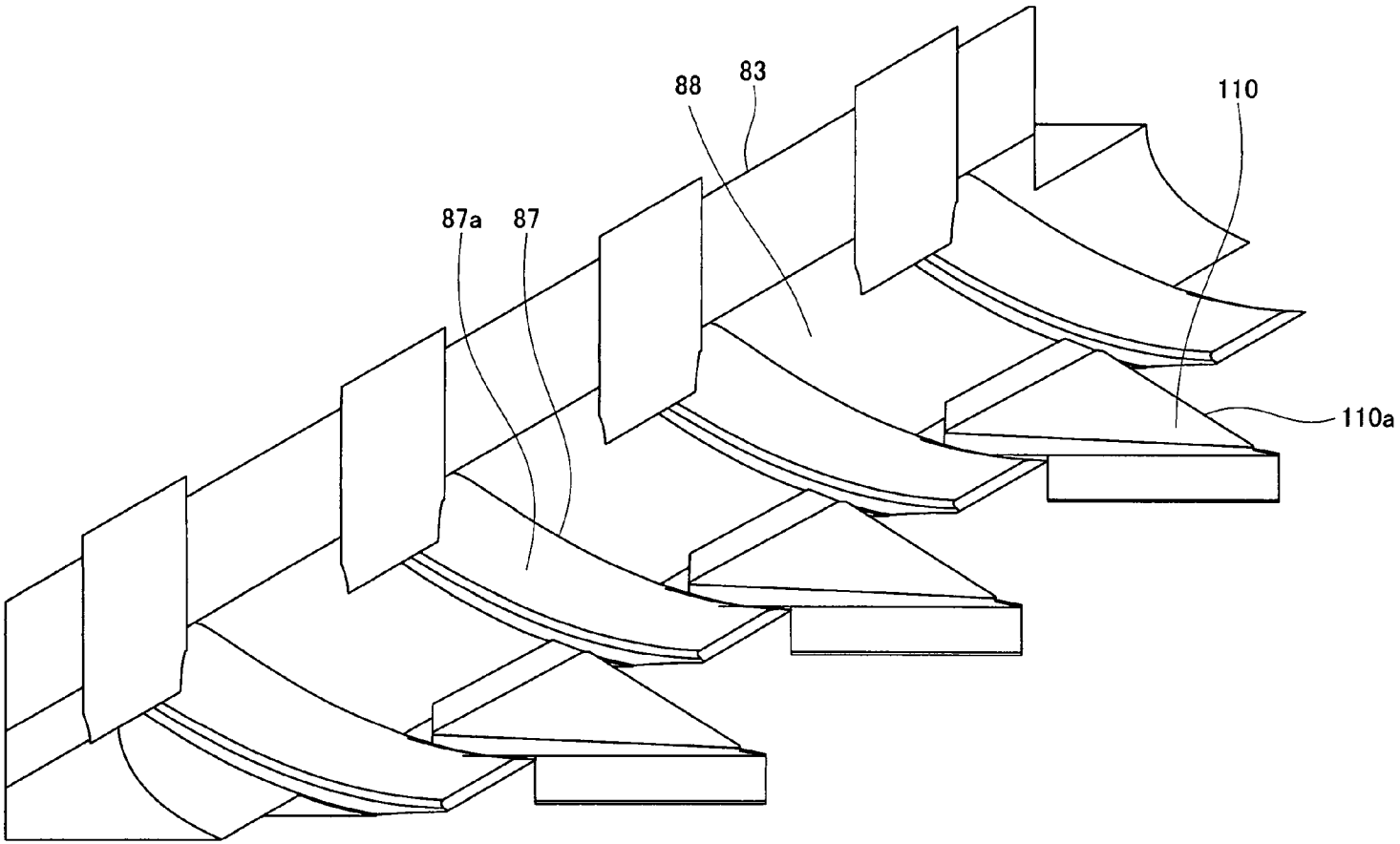
FIG. 9 is an enlarged perspective view showing the turn guide.
Figure 10:
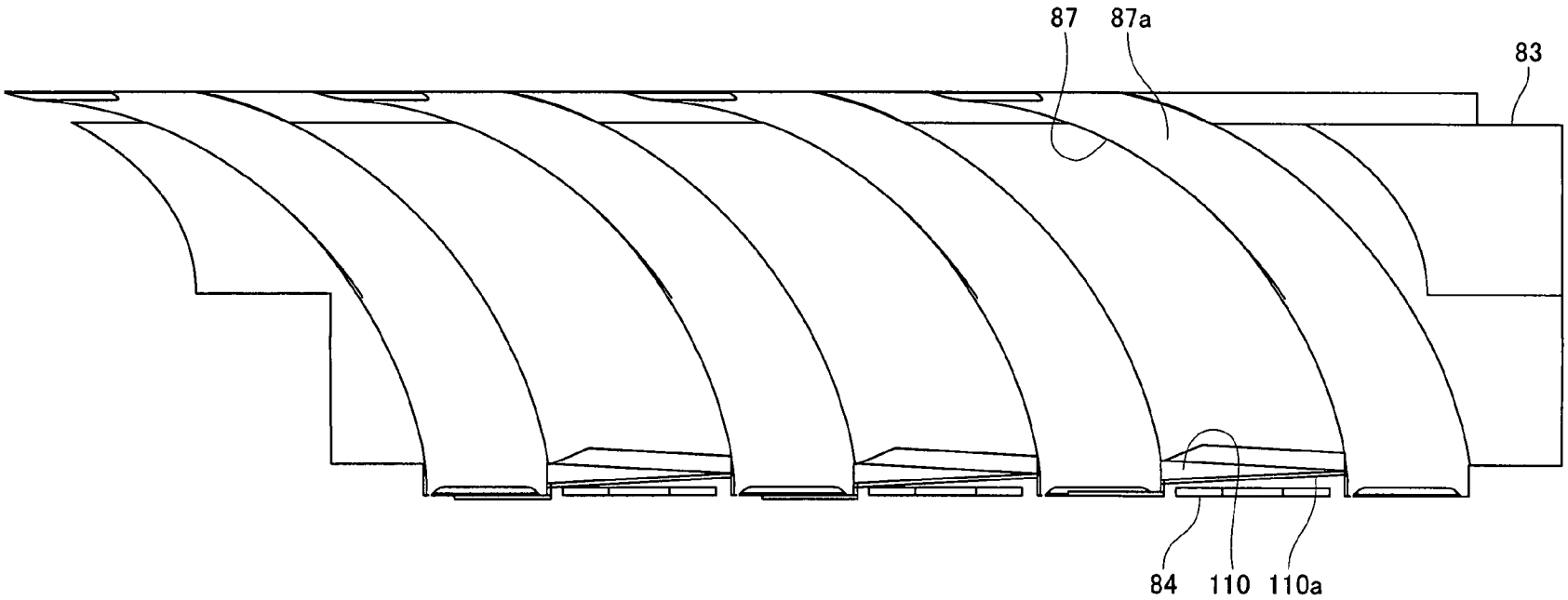
FIG. 10 is a front view showing the turn guide.

FIGS. 8 to 10 show another embodiment of the present invention. This embodiment is based on the configuration of the second paper inverting device 80 shown in FIG. 3. To be specific, an upper first transport device 81 and a lower second transport device 82 are disposed at relative positions where paper transport directions are orthogonal to each other. An inversion axis B of a sheet P is tilted at the relative positions by 45° relative to a direction orthogonal to the paper transport directions and a turn guide 83 is disposed in parallel with the inversion axis B.

Therefore, a corner on one side of the sheet P first reaches the turn guide 83 and then one end of the sheet enters inversion/transfer surfaces 87*a* from the corner. The entry of the end of the sheet P to the inversion/transfer surfaces 87*a* is delayed as being close to a corner on the other side of the sheet P. The sheet P is first inverted from the corner having first entered the inversion/transfer surfaces 87*a* and the start of the inversion is delayed as being close to the corner on the other side of the sheet P, so that the transport direction of the sheet P is changed.

The turn guide 83 has a plurality of escape portions 110 at an inversion start point corresponding to a first transport surface and between guide ribs corresponding to the corner of the sheet. The escape portions 110 are disposed on positions first coming into contact with the sheets P of various sizes in the paper transport direction.

The escape portions 110 are extended from a guide rib disposed inside the corner of the sheet to another guide rib 87 disposed outside the corner of the sheet, and escape portion front ends 110*a* which come into slidable contact with the end of the sheet are formed so as to gradually retreat in the paper transport direction as being close to the guide rib 87 disposed outside the corner of the sheet. The escape portion front ends 110*a* have an elevation angle tilted by a predetermined angle relative to the first transport surface of the first transport device 81. Further, the escape portion front ends 110*a* are tilted by a predetermined angle relative to a direction orthogonal to the transport direction in the first transport surface and are tilted by 30° to 60°.

In this configuration, the escape portions 110 have side edges which are in contact with the guide ribs 87 disposed inside the escape portions 110. The side edges are placed higher than the inversion/transfer surfaces 87*a* of the guide ribs 87 disposed inside the escape portions 110 and are formed along transport belts 84. Further, the escape portion front ends 110*a* are positioned on guide surfaces 88 which are formed between the guide ribs 87 by the rear ends of the escape portions having retreated in the paper transport direction. The escape portions 110 are preferably made up of flexible members separated from the turn guide 83.

With this configuration, when the sheet P is transferred from the first transport surface to a second transport surface, the sheet P is inverted by a predetermined inversion angle of 180° and the direction of the sheet P is changed by a predetermined turning angle of 90° by passage through the turn guide 83.

As the sheet moves in the paper transport direction, the guide ribs 87 guide the end of the sheet with the inversion/transfer surfaces 87*a*, the sheet is first inverted from the corner on one side having first entered the inversion/transfer surfaces, and the surfaces of the sheet P are inverted and curved along the inversion/transfer surfaces 87*a*, following the end of the sheet.

Figure 12:
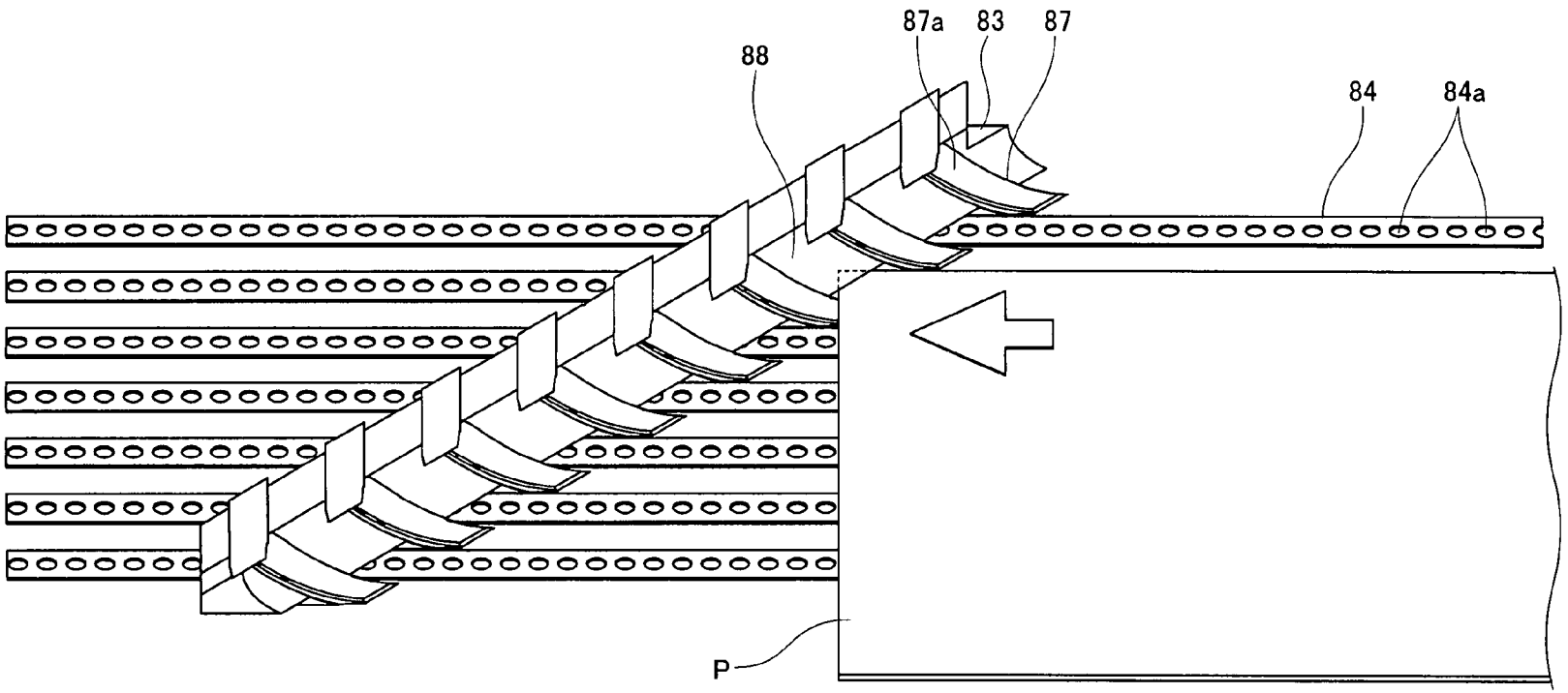
FIG. 12 is a schematic diagram showing a jam caused by the turn guide having no escape portions.

As shown in FIG. 12, when the escape portions 110 are not provided, a corner on one side of the sheet P enters between the guide ribs 87 while being bent lower than the inversion/transfer surfaces 87*a* by a curl and the like of the sheet P. In this case, the corner comes under the guide surface 88 between the guide ribs 87 and is not inverted, thereby interfering with the inversion of an edge on one side of the sheet P, following the corner of the end. Thus a paper jam occurs.

Figure 11:
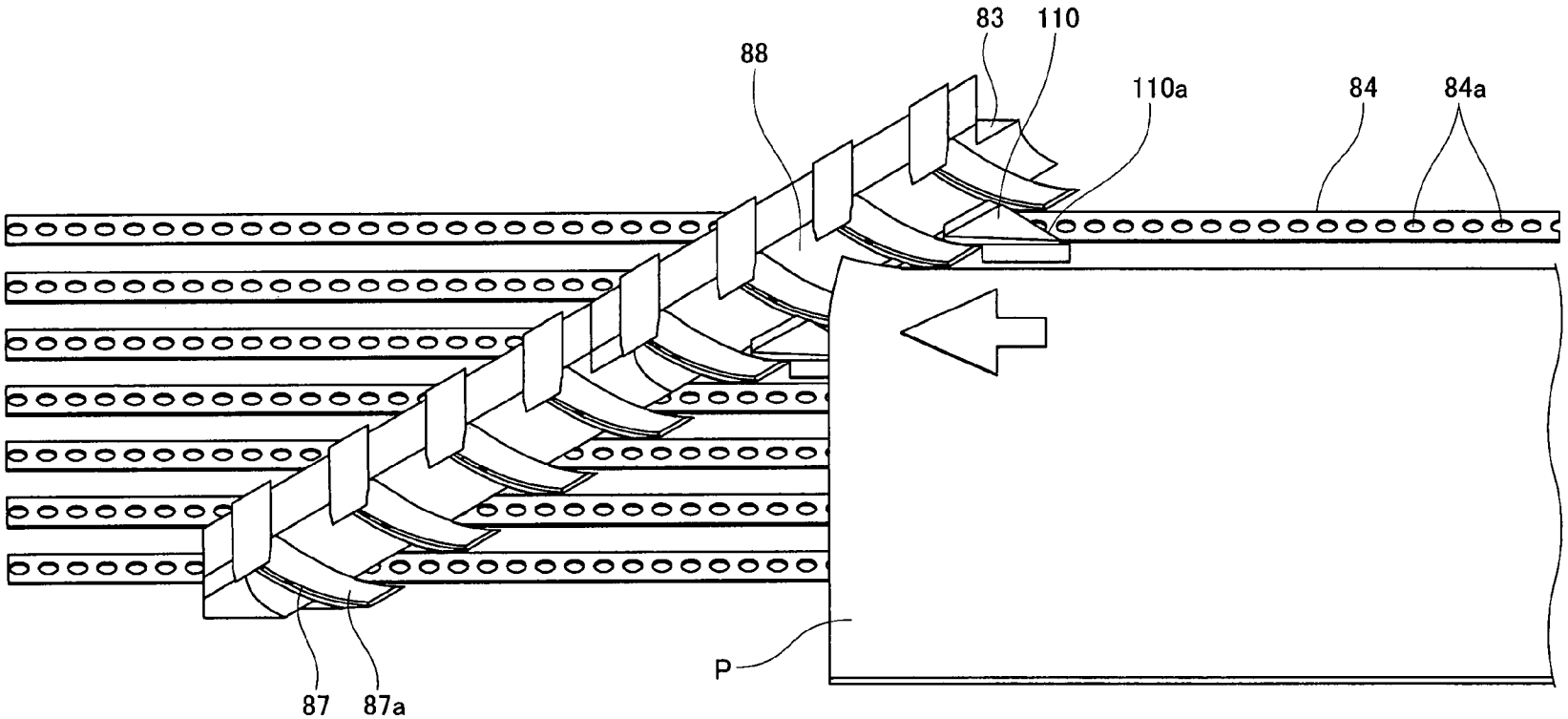
FIG. 11 is a schematic diagram showing the inversion of a sheet by the turn guide.

However, as shown in FIG. 11, the escape portion front ends 110*a* of the escape portions 110 are provided between the guide ribs 87 corresponding to the corner on one side of the sheet P and the escape portion front ends 110*a* come into slidable contact with the edge of the corner of the sheet P which is bent lower than the inversion/transfer surfaces 87*a*. The escape portion front ends 110*a* are formed so as to gradually retreat in the transport direction, so that as the sheet P moves in the paper transport direction, the escape portions 110 guide the end of the sheet upward with the escape portion front ends 110*a*, the position of the corner on one side of the sheet P is corrected, and the corner is smoothly inverted. Thus it is possible to prevent a paper jam.

Figure 13:
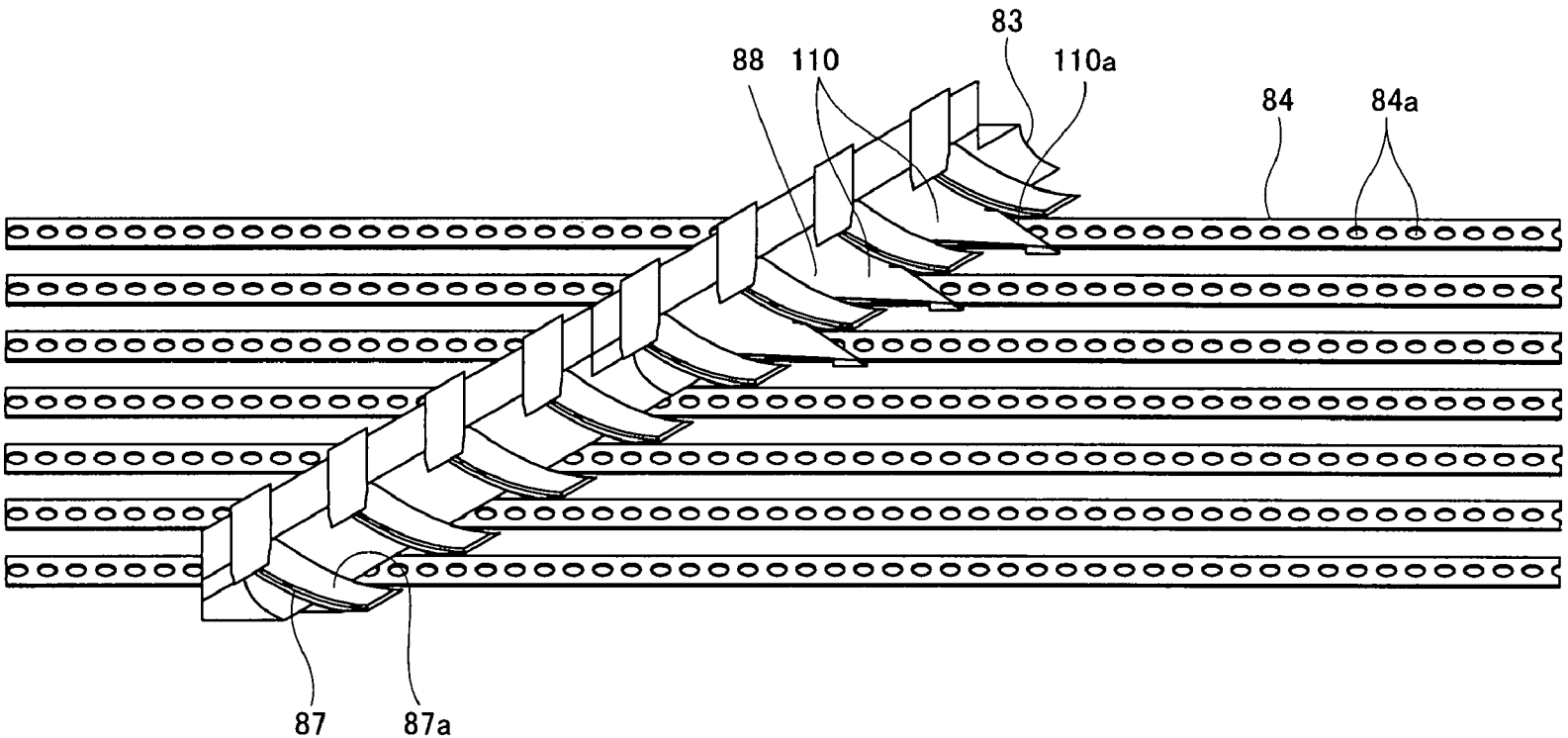
FIG. 13 is a perspective view showing a turn guide in a second paper inverting device according to another embodiment of the present invention.
Figure 14:
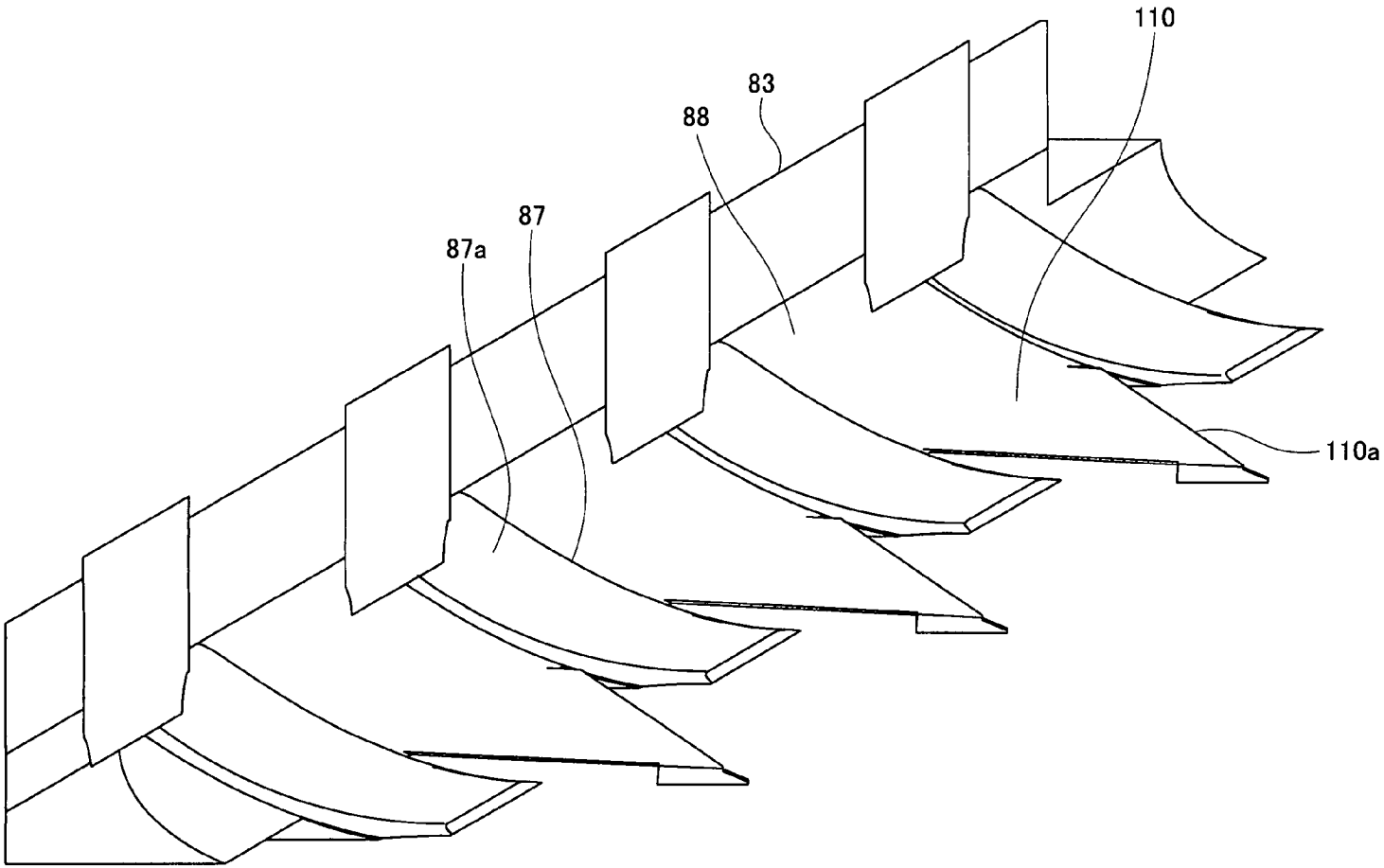
FIG. 14 is an enlarged perspective view showing the turn guide.

As shown in FIGS. 13 and 14, the escape portions 110 may be formed such that the escape portions 110 have side edges coming into contact with the guide ribs 87 disposed inside the corner of the sheet and placed higher than the inversion/transfer surfaces 87*a* of the guide ribs 87 disposed inside the corner of the sheet and the escape portion front ends 110*a* have escape portion rear ends retreated in the paper transport direction and placed higher than the inversion/transfer surfaces 87*a* of the guide ribs 87 disposed outside the corner of the sheet.

The invention claimed is:

1. A paper inverting device for inverting a sheet of paper around an inversion axis by a predetermined inversion angle when the sheet is transferred from a first transport surface to a second transport surface, the paper inverting device comprising:

a first transport device forming the first transport surface and a second transport device forming the second transport surface, the first and second transport devices each including a plurality of transport belts moving on transport paths along a paper transport direction and a suction device for sucking the sheet on the transport belts through suction holes formed on the transport belts, and a turn guide disposed in parallel with the inversion axis between the first transport device and the second transport device, the turn guide having a plurality of guide ribs disposed along the inversion axis and between the transport belts, the guide ribs being in slidable contact with the sheet and having slidable contact portions forming curved inversion/transfer surfaces from inversion start points corresponding to the first transport surface to inversion end points corresponding to the second transport surface, the first transport device and the second transport device being disposed at relative positions where the inversion axis is tilted by a predetermined angle relative to a direction orthogonal to a paper transport direction of the first transport device and a predetermined turning angle being formed between a transport direction of the first transport device and a paper transport direction of the second transport device, the turn guide disposed in parallel with the inversion axis having escape portions at the inversion start points corresponding to the first transport surface and between the guide ribs corresponding to a corner of the sheet, the escape portions being extended from the guide rib disposed inside the corner of the sheet to the guide rib disposed outside the corner of the sheet and having escape portion front ends which come into slidable contact with an end of the sheet so as to gradually retreat in the paper transport direction as being close to the guide rib disposed outside the corner of the sheet.

2. The paper inverting device according to claim 1, wherein the escape portion front ends are tilted by a predetermined angle relative to the first transport surface of the first transport device and are tilted by a predetermined angle relative to a direction orthogonal to the transport direction, and the escape portions having retreated in the paper transport direction have rear ends disposed on guide surfaces formed between the guide ribs.

3. The paper inverting device according to claim 1, wherein the escape portions are made up of flexible members separated from the turn guide.

4. The paper inverting device according to claim 1, wherein the guide ribs are arranged with a predetermined pitch along the inversion axis and are formed with a center distance of 20 mm to 50 mm in a direction orthogonal to the paper transport direction.

5. The paper inverting device according to claim 1, wherein the first and second transport devices each include low-friction members on portions where the transport belts slide.

6. The paper inverting device according to claim 1, wherein the transport belts have a plurality of protrusions formed on a surface coming into contact with the sheet of paper.

7. The paper inverting device according to claim 1, wherein the first and second transport devices each include belt rollers for driving the transport belts, and the belt rollers have a plurality of protrusions formed on portions pressed to the transport belts.

8. The paper inverting device according to claim 1, wherein the first and second transport devices each include paper support members between the plurality of transport belts.

9. The paper inverting device according to claim 1, wherein the escape portions are made up of flexible members separated from the turn guide.

* * * * *